US010777403B2

(12) United States Patent
Nakabayashi et al.

(10) Patent No.: US 10,777,403 B2
(45) Date of Patent: Sep. 15, 2020

(54) TUNGSTEN ELECTRODE MATERIAL

(71) Applicant: A.L.M.T. Corp., Tokyo (JP)

(72) Inventors: Seiji Nakabayashi, Toyama (JP); Tomohiro Takida, Toyama (JP)

(73) Assignee: A.L.M.T. Corp., Tokyo (JP)

( * ) Notice: Subject to any disclaimer, the term of this patent is extended or adjusted under 35 U.S.C. 154(b) by 0 days.

(21) Appl. No.: 16/499,157

(22) PCT Filed: Mar. 23, 2018

(86) PCT No.: PCT/JP2018/011801

§ 371 (c)(1),
(2) Date: Sep. 27, 2019

(87) PCT Pub. No.: WO2018/181028

PCT Pub. Date: Oct. 4, 2018

(65) Prior Publication Data

US 2020/0066505 A1 Feb. 27, 2020

(30) Foreign Application Priority Data

Mar. 31, 2017 (JP) ..... 2017-071801

(51) Int. Cl.
*H01J 61/073* (2006.01)
*C22C 27/04* (2006.01)

(52) U.S. Cl.
CPC ..... *H01J 61/0735* (2013.01); *C22C 27/04* (2013.01)

(58) Field of Classification Search
CPC ..... H01J 1/146; H01J 9/42; H01J 61/0735; H01J 61/0737; H01B 1/08
See application file for complete search history.

(56) References Cited

U.S. PATENT DOCUMENTS

| | | | |
|---|---|---|---|
| 6,051,165 | A | 4/2000 | Billings |
| 2005/0104521 | A1 | 5/2005 | Berndanner et al. |
| 2006/0220559 | A1 | 10/2006 | Ikeuchi |
| 2011/0243184 | A1 | 10/2011 | Nakabayashi et al. |

FOREIGN PATENT DOCUMENTS

| | | | |
|---|---|---|---|
| JP | S51-84497 | A | 7/1976 |
| JP | 2005-519435 | A | 6/2005 |
| JP | 2005-285676 | A | 10/2005 |
| JP | 2006-286236 | A | 10/2006 |
| JP | 2008-286236 | A | 11/2008 |
| JP | 4486163 | B1 | 6/2010 |
| JP | 2010-159484 | A | 7/2010 |
| JP | 2010-161061 | A | 7/2010 |
| WO | 2010/067781 | A1 | 6/2010 |

*Primary Examiner* — Joseph L Williams
(74) *Attorney, Agent, or Firm* — Baker Botts L.L.P.; Michael A. Sartori

(57) ABSTRACT

A tungsten electrode material contains a tungsten-based material and oxide particles dispersed in the tungsten-based material. The oxide particles are composed of an oxide solid solution in which a Zr oxide and/or an Hf oxide and an oxide of at least one rare earth selected from the group consisting of Sc, Y, La, Ce, Pr, Nd, Sm, Eu, Gd, Tb, Dy, Ho, Er, Tm, Yb, and Lu are dissolved as a solid solution. A content of the rare-earth oxide with respect to a total amount of the Zr oxide and/or the Hf oxide and the rare-earth oxide is not lower than 66 mol % and not higher than 97 mol %, a content of the oxide solid solution is not lower than 0.5 mass % and not higher than 9 mass %, and the remainder is composed substantially of tungsten.

5 Claims, 4 Drawing Sheets

ELECTRODE MATERIAL ACCORDING TO CONVENTIONAL TECHNIQUE

TUNGSTEN ELECTRODE MATERIAL

TECHNICAL FIELD

The present invention relates to a tungsten electrode material. The present application claims priority to Japanese Patent Application No. 2017-071801 filed on Mar. 31, 2017, the entire contents of which are herein incorporated by reference.

BACKGROUND ART

A tungsten electrode material has conventionally been disclosed in U.S. Pat. No. 6,051,165 (PTL 1), Japanese National Patent Publication No. 2005-519435 (PTL 2), Japanese Patent Laying-Open No. 2005-285676 (PTL 3), Japanese Patent Laying-Open No. 2006-286236 (PTL 4), and Japanese Patent No. 4486163 (PTL 5). A work function of tungsten is disclosed in Japanese Patent Laying-Open No. 2010-161061 (PTL 6).

CITATION LIST

Patent Literature

PTL 1: U.S. Pat. No. 6,051,165

PTL 2: Japanese National Patent Publication No. 2005-519435

PTL 3: Japanese Patent Laying-Open No. 2005-285676

PTL 4: Japanese Patent Laying-Open No. 2006-286236

PTL 5: Japanese Patent No. 4486163

PTL 6: Japanese Patent Laying-Open No. 2010-161061

SUMMARY OF INVENTION

A tungsten electrode material contains a tungsten-based material and oxide particles dispersed in the tungsten-based material. The oxide particles are composed of an oxide solid solution in which a Zr oxide and/or an Hf oxide and an oxide of at least one rare earth selected from the group consisting of Sc, Y, La, Ce, Pr, Nd, Sm, Eu, Gd, Tb, Dy, Ho, Er, Tm, Yb, and Lu are dissolved as a solid solution. A content of the oxide of the rare earth with respect to a total amount of the Zr oxide and/or the Hf oxide and the oxide of the rare earth is not lower than 66 mol % and not higher than 97 mol %, a content of the oxide solid solution is not lower than 0.5 mass % and not higher than 9 mass %, and a remainder is composed substantially of tungsten.

DETAILED DESCRIPTION

Figure 1:
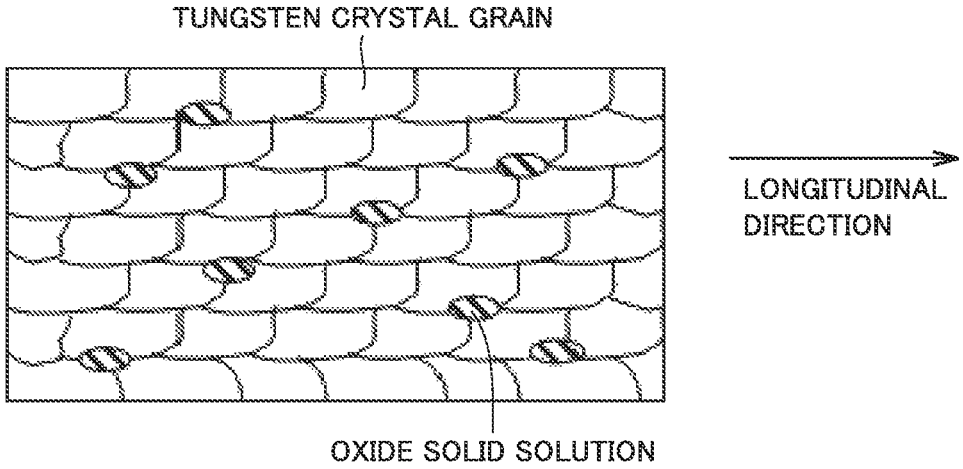
FIG. 1 is a diagram including a partial cross-section of a tungsten electrode material in an embodiment.

Problem to be Solved by the Present Disclosure

A tungsten electrode material is required to be less in movement of a luminescent spot.

Effect of the Present Disclosure

According to the present disclosure, a tungsten electrode material less in movement of a luminescent spot can be provided.

Description of Embodiment of the Present Invention

Embodiments of the present invention are initially listed and described.

Further improvement in electrode characteristics has recently been demanded, and the technique above has been insufficient. One demanded performance of a tungsten electrode material to be used for a discharge lamp is being less in movement of a luminescent spot. In developing a material alternative to thoriated tungsten (which contains thoria ($ThO_2$) in tungsten) used as a tungsten electrode material for a discharge lamp, improvement in performance to achieve less movement of a luminescent spot has not been sufficient.

In PTL 5, an oxide exists in a form of an oxide solid solution. Since the oxide exists in a stable manner even at a high temperature, long lifetime representing one required performance is achieved. Attention, however, has not been paid to movement of a luminescent spot.

In contrast, an embodiment of the present invention has obtained a new finding that a partially molten oxide rather than an oxide in a form of a solid contributes to discharging, which is effective in lessening of voltage variation and a current variation rate representing an alternative indicator of movement of a luminescent spot. A reason for achieving such an effect may be as set forth below.

Though tungsten and an oxide exist at a surface of an electrode, it is the oxide that contributes to discharging. It is estimated that, in the embodiment of the present invention, the oxide is partially molten and an area of the exposed oxide is greater and contribution to discharging is also greater than when the oxide remains as a solid.

When a rare-earth oxide exists as a simple substance in a tungsten electrode material, the rare-earth oxide melts too fast, the oxide evaporates also fast while a discharge lamp is turned on, and voltage variation and a current variation rate during discharging may not be lessened. It is estimated that, while a solid solution of a Zr/Hf oxide and a rare-earth oxide suppresses melting of the rare-earth oxide, some of the solid solution covers a surface of the electrode and contributes to discharging, which leads to a phenomenon of lessened voltage variation and current variation rate during discharging.

In order to solve the problem above, as a result of dedicated studies, the present inventors paid attention to absence of technical investigation about correlation between electrode characteristics which had conventionally been focused on (change over time in thermionic emission or thermionic emission characteristics) and a form of existence of an oxide in the electrode, and subjected oxide mixed powders before being mixed with tungsten powders shown in each PTL above to X-ray diffraction.

Consequently, the present inventors confirmed that the oxide mixed powders were mixed powders in which different oxides were simply mixed in each of PTLs 1 to 4.

In order to observe a form of existence in an exemplary sintered compact which was a mixture of tungsten powders and the above-described mixed powders in which different oxides had simply been mixed, the present inventors conducted further testing by using electric current activated sintering of tungsten in which solid-phase sintering was conducted at a temperature just below a melting point with a shape being maintained.

Consequently, as will be described later with reference to Comparative Examples, it was confirmed that each oxide existed independently in a tungsten-based material (which is referred to as "in a tungsten electrode material" below).

PTL 5 observed an oxide solid solution, and a form of existence was an oxide solid solution. It was newly found that a composition of the oxide solid solution affected other electrode characteristics (voltage variation and a current variation rate).

As a result of further studies based on results of the further testing above, the present inventors derived an idea that further improvement in electrode characteristics could be achieved by preparing oxide particles to be dispersed in a tungsten electrode material in a form of an oxide solid solution and that the improvement could be obtained within a range of composition of the oxide not found in conventional techniques. As a result of further studies, the present inventors conducted further technical investigation about correlation of electrode characteristics with a form of existence and a composition of an oxide in the electrode.

As a result of further studies based on the findings above, the present inventors found that a tungsten electrode material which could achieve improvement in electrode characteristics as compared with a conventional example could be provided by using a material in place of a thorium oxide, by taking such measures as fabricating in advance oxide particles in which a Zr oxide and/or an Hf oxide and an oxide of at least one rare earth selected from Sc, Y, and lanthanoid (La, Ce, Pr, Nd, Sm, Eu, Gd, Tb, Dy, Ho, Er, Tm, Yb, and Lu (except for Pm representing a radioactive element (which will be referred to as "lanthanoid" below)) were dissolved as a solid solution (which is also referred to as an "oxide solid solution" below), mixing the oxide particles with tungsten powders or fabricating in advance mixed powders in which the oxide solid solution was formed in the tungsten powders, and dispersing the oxide solid solution in a tungsten electrode material by pressing and sintering the mixed powders.

A tungsten electrode material according to one manner of the present invention contains a tungsten-based material and oxide particles dispersed in the tungsten-based material. The oxide particles are composed of an oxide solid solution in which a Zr oxide and/or an Hf oxide and an oxide of at least one rare earth selected from the group consisting of Sc, Y, La, Ce, Pr, Nd, Sm, Eu, Gd, Tb, Dy, Ho, Er, Tm, Yb, and Lu are dissolved as a solid solution. A content of the oxide of the rare earth with respect to a total amount of the Zr oxide and/or the Hf oxide and the oxide of the rare earth is not lower than 66 mol % and not higher than 97 mol %, a content of the oxide solid solution is not lower than 0.5 mass % and not higher than 9 mass %, and a remainder is composed substantially of tungsten.

The oxide solid solution existing in the electrode material refers to an electrode material in which at least one type of oxide solid solution (a single type of oxide solid solution in FIG. 1) is dispersed at a grain boundary or in a grain of tungsten crystal grains in a cross-sectional structure of the electrode material as shown in FIG. 1.

The "oxide solid solution" refers to a state that two or more solid oxides are uniformly dissolved at any composition ratio. When this state is compared to a liquid, the state does not correspond to a state of two-phase separation (a mixture) without solubility to each other like water and oil but to a uniformly dissolved state (a solution) of one phase like water and ethanol. The "uniformly dissolved state of one phase" corresponds to a solid solution of a solid.

Therefore, the oxide solid solution refers to such a state of one phase that Zr and/or Hf oxide(s) and an oxide of at least one rare earth selected from the group consisting of Sc, Y, La, Ce, Pr, Nd, Sm, Eu, Gd, Tb, Dy, Ho, Er, Tm, Yb, and Lu are uniformly dissolved.

<Type of Oxide>

A type of oxide will now be described.

An exemplary oxide solid solution of an oxide of a rare-earth element and a Zr oxide and/or an Hf oxide will be described below.

<Ratio Between Zr Oxide or/and Hf Oxide and Rare-Earth Oxide in Electrode Material>

In an electrode material in the present embodiment, a range of a composition of a rare-earth oxide for forming an oxide solid solution shown in Table 1 to a Zr oxide or/and an Hf oxide and the rare-earth oxide is not lower than 66 mol % and not higher than 97 mol % and preferably not lower than 70 mol % and not higher than 95 mol %.

TABLE 1

| Rare-Earth Oxide | Range of Composition of Rare-Earth Oxide for Forming Oxide Solid Solution |
|---|---|
| $Sc_2O_3$ | 40 to 100 mol % |
| $Y_2O_3$ | 40 to 100 mol % |
| $La_2O_3$ | 33 to 100 mol % |
| $CeO_2$ | 18 to 100 mol % |
| $Pr_2O_3$ | 50 to 100 mol % |
| $Nd_2O_3$ | 50 to 100 mol % |
| $Sm_2O_3$ | 55 to 100 mol % |
| $Eu_2O_3$ | 52 to 100 mol % |
| $Gd_2O_3$ | 52 to 100 mol % |
| $Tb_2O_3$ | 57 to 100 mol % |
| $Dy_2O_3$ | 62 to 100 mol % |
| $Ho_2O_3$ | 60 to 100 mol % |
| $Er_2O_3$ | 65 to 100 mol % |
| $Tm_2O_3$ | 55 to 100 mol % |
| $Yb_2O_3$ | 58 to 100 mol % |
| $Lu_2O_3$ | 58 to 100 mol % |

(100 mol % not inclusive)

Mol % in Table 1 is calculated in an expression below.

[Expression 1]

$$\text{Mol \% in Table 1} = \frac{\text{Amount of Substance of Rare-Earth Oxide (mole)}}{\text{Amount of Substance of Zr Oxide or/and Hf Oxide (mole)} + \text{Amount of Rare-Earth Oxide (mole)}}$$

When the ratio is lower than 66 mol % or exceeds 97 mol %, electrode characteristics (voltage variation and a current variation rate) are adversely affected. It was confirmed that luminance was stable within a range from 66 to 97 mol %. This may be because a liquid phase is moderately produced in that range. The liquid phase runs along grain boundaries at a surface of the electrode, seeps out, and contributes to effective and continuous generation of discharging. Therefore, voltage variation and the current variation rate may be lessened and movement of a luminescent spot may be lessened.

<Content of Oxide Solid Solution in Electrode Material>

In the tungsten electrode material in the embodiment of the present invention, a content of the oxide solid solution to a total amount of the electrode material is not lower than 0.5 mass % and not higher than 9 mass % (the remainder being composed substantially of tungsten) and preferably not lower than 0.8 mass % and not higher than 3 mass %.

When the content is lower than 0.5 mass %, an effect of dispersion of the oxide solid solution is not obtained and the electrode characteristics are not improved. When the content exceeds 9 mass %, it is difficult to perform sintering and manufacturing of an electrode fails.

<Form of Oxide Solid Solution and Method of Checking Thereof>

When Zr and/or Hf oxide(s) and an oxide of at least one rare earth selected from the group consisting of Sc, Y, La, Ce, Pr, Nd, Sm, Eu, Gd, Tb, Dy, Ho, Er, Tm, Yb, and Lu exist in a tungsten electrode material, there may be three forms.

First Form

A form in which Zr and/or Hf oxide(s) and an oxide of at least one rare earth selected from the group consisting of Sc, Y, La, Ce, Pr, Nd, Sm, Eu, Gd, Tb, Dy, Ho, Er, Tm, Yb, and Lu are dissolved as a solid solution in a tungsten electrode material Second Form A form of an oxide in which Zr and/or Hf oxide(s) and an oxide of at least one rare earth selected from the group consisting of Sc, Y, La, Ce, Pr, Nd, Sm, Eu, Gd, Tb, Dy, Ho, Er, Tm, Yb, and Lu exist at a prescribed molar ratio and are chemically bonded in a tungsten electrode material. Oxides chemically bonded at a prescribed molar ratio refer to oxides composed of two or more metal elements and oxygen as expressed in a chemical formula $La_2Zr_2O_7$ and chemically bonded in accordance with a molar ratio in the chemical formula, and they are referred to as a "composite oxide" below.

Third Form

A form in which Zr and/or Hf oxide(s) and an oxide of at least one rare earth selected from the group consisting of Sc, Y, La, Ce, Pr, Nd, Sm, Eu, Gd, Tb, Dy, Ho, Er, Tm, Yb, and Lu are mixed in a tungsten electrode material, which will be referred to as a "mixed oxide" below.

Therefore, even though a constituent element and a composition ratio are identical, a peak specific to an oxide solid solution of Zr and/or Hf oxide(s) and oxide(s) of Sc, Y, and/or lanthanoid appears in the first form, a peak specific to a composite oxide (an oxide shown in PTL 1) appears in the second form, and peaks of Zr and/or Hf oxide(s) and oxide(s) of Sc, Y, and/or lanthanoid in a mixture appear in the third form (oxides shown in PTLs 2, 3, and 4), and each of them can be identified.

The first to third forms can be identified by X-ray diffraction, because they are different from one another in lattice constant or crystal structure depending on a state of existence of an oxide and a specific X-ray diffraction peak in accordance with the state of existence appears.

Specifically, X-ray diffraction peaks (an angle and intensity) of the second and third forms have already been known. An X-ray diffraction peak of the first form has an angle shifted from the X-ray diffraction peak of the third form, because an angle of the diffraction peak is dependent on a lattice constant and the lattice constant is varied as a result of formation of a solid solution of an oxide. The X-ray diffraction peak of the third form appears as an already known peak of each oxide.

According to results of further testing conducted by the present inventors, it was found that an oxide before being mixed with tungsten powders shown in PTL 1, that is, $La_2Zr_2O_7$, was in a state that constituent elements were chemically bonded at a prescribed molar ratio.

Therefore, the oxide obtained by the method in PTL 1 corresponds to the second form.

Since PTL 4 does not define a state of existence of the oxide, the present inventors conducted further testing based on Examples as below in order to obtain powders of an oxide in which a metal oxide of La and a metal oxide of Zr coexisted.

A ratio of mixing the metal oxides was set to a molar ratio of $La_2O_3$:$ZrO_2$=1:2. This condition satisfies "a molar ratio of an oxide AxOy of at least one kind of metal selected from lanthanum, cerium, yttrium, scandium, and gadolinium . . . to an oxide BzOt of at least one kind of metal selected from titanium, zirconium, hafnium, niobium, and tantalum is in the range of $A/B \leq 1.0$" in claim 4 of PTL 4, and corresponds to A/B=0.5 in this claim.

Initially, an La metal oxide ($La_2O_3$ manufactured by Wako Pure Chemical Corporation at a purity of 99 mass %) and a Zr metal oxide ($ZrO_2$ manufactured by Wako Pure Chemical Corporation at a purity of 99 mass %) that were commercially available were mixed at the molar ratio above and the mixture was crushed for five minutes by a ball mill.

Then, the crushed powders were pressed at a pressure of 98 MPa to fabricate a compact.

Then, the obtained compact was sintered in air atmosphere at 1400° C. and thereafter crushed again to thereby obtain a metal oxide. After the metal oxide was naturally cooled, it was analyzed by X-ray diffraction. Then, mainly $La_2O_3$ and $ZrO_2$ were observed, and only some $La_2Zr_2O_7$ which was a stoichiometric compound of oxides at a prescribed molar ratio was observed. It was found that a mixture of an La metal oxide and a Zr metal oxide each in a state of a simple substance mainly existed also after heating.

Therefore, it was found that the oxide obtained by the method in PTL 4 (what is referred to as a "coexisting substance" in PTL 4) fell under the second and third forms and PTLs 2 and 3 fell under the third form similarly to PTL 4, that is, they were not in the form of an oxide solid solution.

As described above, according to X-ray diffraction, it was found that only the oxide in the embodiment of the present invention fell under the first form and none of PTLs 1 to 4 fell under the first form.

In other words, it was found to be difficult to obtain a mixture containing an oxide solid solution in tungsten powders simply by heating a mixture of tungsten powders and an oxide shown in each of PTLs 1 to 4.

For the X-ray diffraction above, RAD-2X manufactured by Rigaku was employed and measurement was conducted under a condition of 40 kV and 30 mA in a Cu tube, or EMPYREAN manufactured by Spectris was employed and measurement was conducted under a condition of 45 kV and 40 mA in a Cu tube.

As set forth above, it was confirmed in the further testing and X-ray diffraction that one manner of the present invention and the conventional techniques were fundamentally different from each other in a form of oxide powders before being mixed with tungsten powders.

Figure 2:
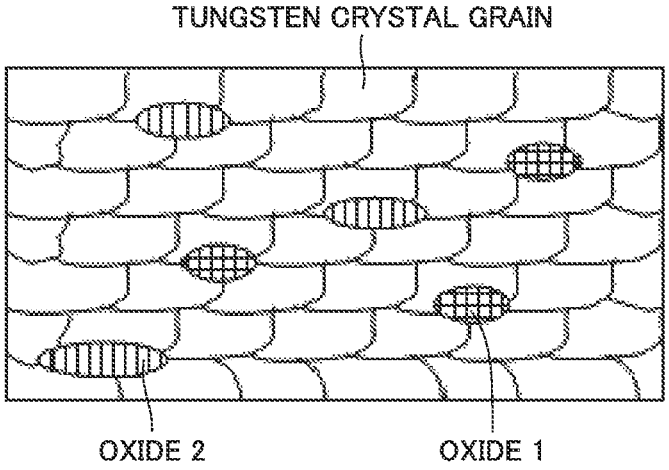
FIG. 2 is a diagram including a partial cross-section of a conventional tungsten electrode material.

An electrode made of oxides shown in PTLs 1 to 4 has a cross-sectional structure as shown in FIG. 2. Specifically, such an electrode is derived from the technique to use powders in which no oxide solid solution is formed. When a mixture of oxides is employed, an electrode material in which two or more of a Zr or Hf oxide and oxides of Sc, Y, and lanthanoid are dispersed independently of one another is obtained. When a composite oxide is employed, an electrode material in which at least one composite oxide of a Zr or Hf oxide and oxides of Sc, Y, and lanthanoid is dispersed is obtained. FIG. 2 shows an example of a mixture of two types of oxides or an example of two types of composite oxides.

PTL 5 and the manner in the present invention are different from each other in composition of an oxide solid solution.

<State of Existence of Oxide Solid Solution in Electrode Material and Method of Checking Thereof>

A state of existence of an oxide in an electrode material can be checked by X-ray diffraction by emitting X-rays to a cut plane of the electrode material.

In another method, only tungsten can chemically be dissolved to separate and collect an oxide, and a state of a solid solution of the oxide can be checked by X-ray diffraction.

A method of observing existence and a sequence of atoms of an oxide by using a transmission electron microscope (TEM) and a method of using an energy dispersive X-ray spectrometer or an electron probe micro analyzer (EPMA) are available as still other checking methods.

A result of X-ray diffraction of a state of existence of an oxide solid solution will be described later with reference to Examples and Comparative Examples.

<Method of Manufacturing Tungsten Electrode Material>

A method of manufacturing a tungsten electrode material will now be described.

Figure 3:
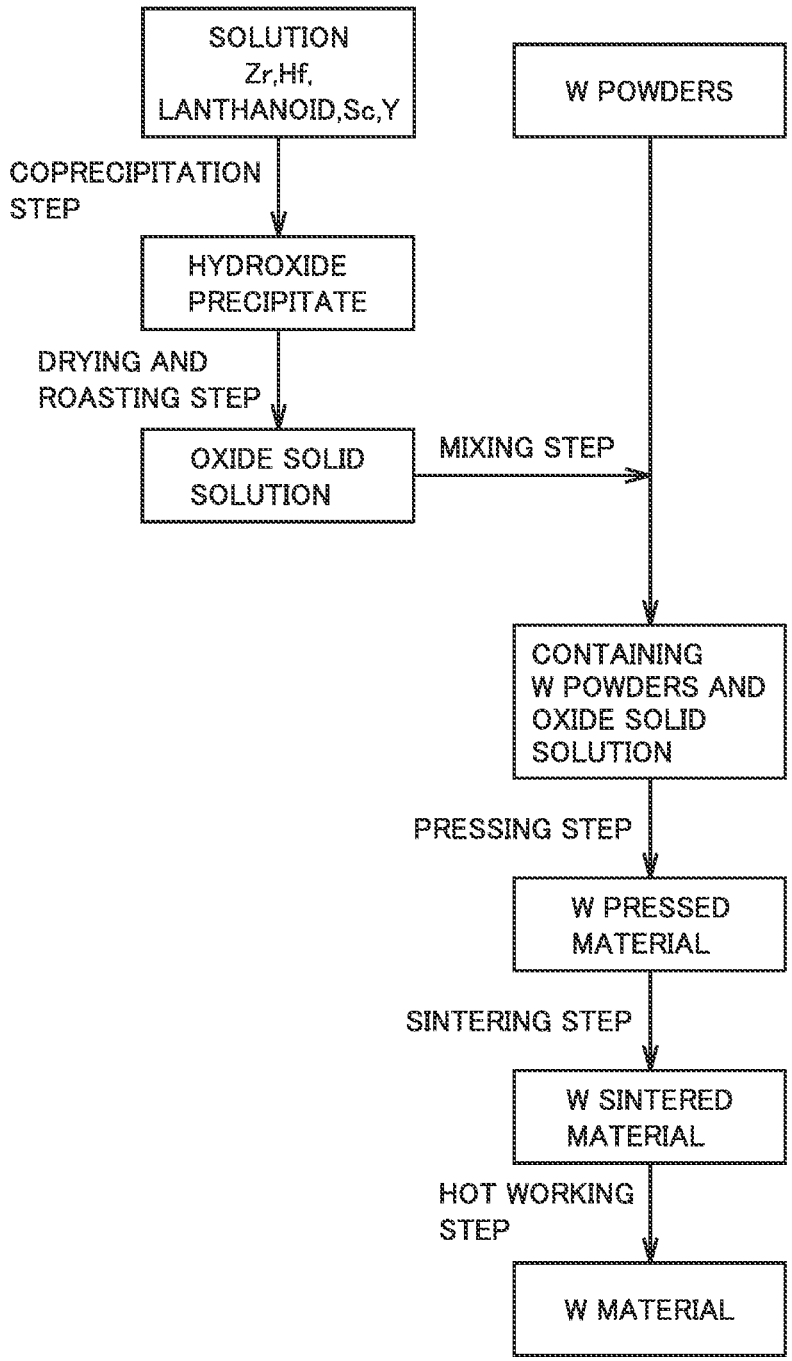
FIG. 3 is a diagram of a process of manufacturing a tungsten electrode material.
Figure 4:
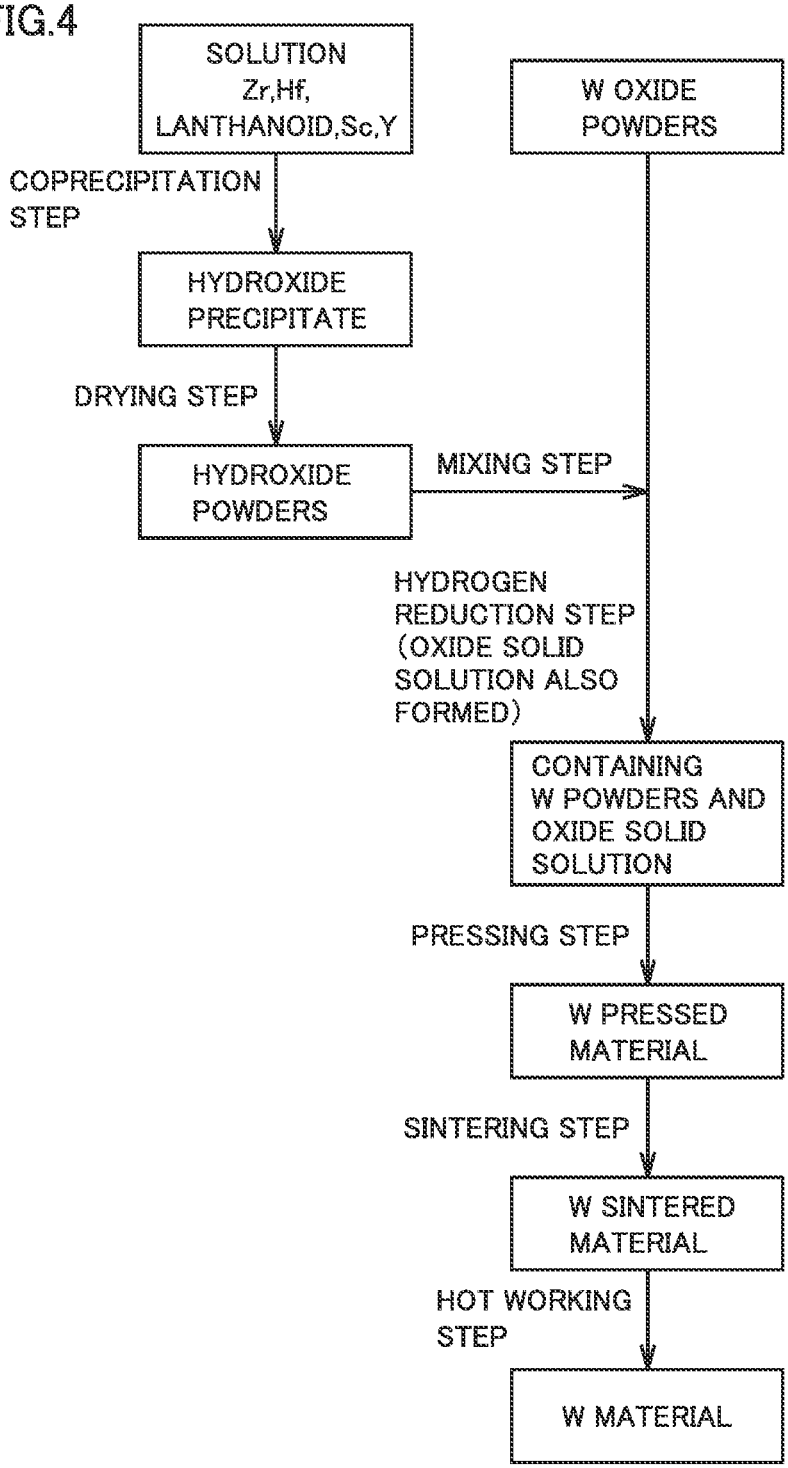
FIG. 4 is a diagram of a process of manufacturing a tungsten electrode material.
Figure 5:
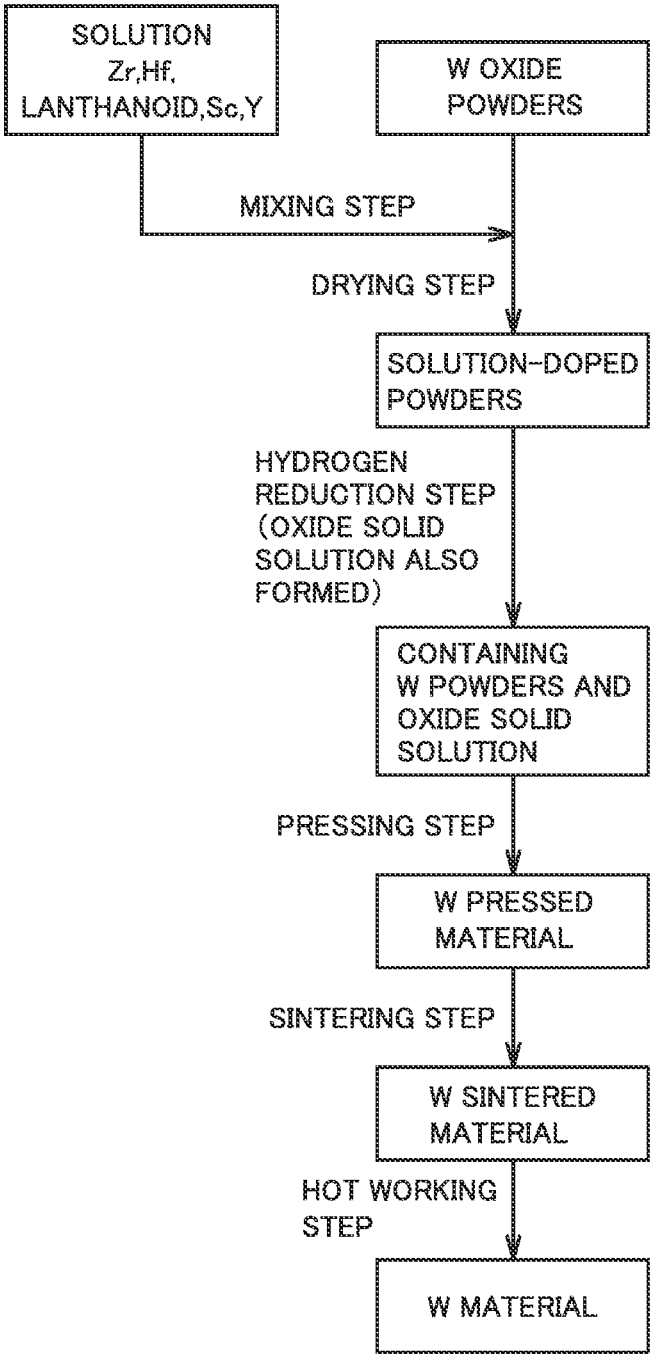
FIG. 5 is a diagram of a process of manufacturing a tungsten electrode material.

As shown in FIGS. 3 to 5, there are three methods of fabricating an electrode in which an oxide solid solution is dispersed. The present invention is not limited to these fabrication methods.

The fabrication method in FIG. 3 uses tungsten powders and the fabrication methods in FIGS. 4 and 5 use tungsten oxide powders. A fabrication method can be selected depending on whether a starting source material is tungsten powders or tungsten oxide powders.

The fabrication method in FIG. 3 is a method of fabricating an oxide solid solution in advance and then mixing the same, whereas the fabrication methods in FIGS. 4 and 5 are each a method of mixing a mixture as a precursor of an oxide solid solution with a tungsten oxide and converting the precursor into an oxide solid solution in a subsequent step.

The fabrication method will be described below for each manufacturing method shown in FIGS. 3 to 5.

<Fabrication Method According to Manufacturing Method in FIG. 3>

[Step of Fabricating Hydroxide Precipitate]

According to the manufacturing method in FIG. 3, initially, by using a coprecipitation method, Zr and/or Hf hydroxide(s) and a hydroxide of at least one rare earth selected from the group consisting of Sc, Y, La, Ce, Pr, Nd, Sm, Eu, Gd, Tb, Dy, Ho, Er, Tm, Yb, and Lu (which are abbreviated as lanthanoid, Sc, and Y) is fabricated. In an example of Zr and La, a step of fabricating an oxide solid solution composed of 20 mol % of $ZrO_2$ and 80 mol % of $La_2O_3$ is shown below.

Initially, a Zr chloride (at a purity of 99.9 mass %) and an La chloride (at a purity of 99.9 mass %) are dissolved in water. A mass ratio between a chloride $ZrCl_4$ and a chloride $LaCl_3$ dissolved in water is set such that a molar ratio therebetween is set to La/(La+Zr)=0.4. This is defined as a solution A.

Preparation is performed such that a concentration of solution A is set to 0.5 mol/dm$^3$ with respect to a total mole of Zr and La.

Then, solution A is stirred. Solution A is acid. A sodium hydroxide (at a purity of 99 mass %) is dissolved in water and preparation is performed such that a concentration is set to 0.5 mol/dm$^3$ (which is defined as a solution B). Solution B is alkaline. By dropping aqueous solution B into stirred solution A, a neutralization reaction occurs. Then, Zr ions and La ions are both converted to hydroxides and precipitation occurs.

Solution B is continued to be dropped. At a time point when pH of solution A exceeds pH 7, the neutralization reaction is completed. Alternatively, a concentration and an amount (a volume) of solutions A and B should only be determined such that all of metal ions in solution A and $OH^-$ ions in solution B react with each other.

A precipitate of the hydroxide can be separated by using settling, filtrating, and a centrifuge. After excessive $OH^-$ ions and other ions contained in the precipitate of the hydroxide are removed by repeating washing with water and separation as appropriate, the precipitate of the hydroxide (which is referred to as a "hydroxide precipitate" below) is obtained.

Conditions for fabrication are not limited to the method above. For example, in the coprecipitation method, the method of fabricating powders of an oxide solid solution can be made proper by (1) using a nitrate or a sulfate instead of a chloride, (2) using a basic solution such as ammonia water instead of a sodium hydroxide solution, (3) making adjustment such as increasing a concentration of a solution, (4) making adjustment such as increasing a temperature of a solution during formation of a precipitate, and (5) setting a concentration and an amount (a volume) of solutions A and B to achieve relatively high pH at the time of end of mixing of solutions.

[Step of Fabricating Powders of Hydroxide]

Dried powders are then fabricated by heating the hydroxide precipitate. A method of heating the hydroxide precipitate to a temperature approximately from 100° C. to 250° C. with the use of an evaporating dish, a spray dryer, or a vacuum dryer can be used for drying the hydroxide precipitate. The powders are powders of hydroxides of Zr and La that are slightly wet. Though moisture is preferably completely removed, it is removed also in a next drying and roasting step (heat treatment).

[Step of Fabricating Oxide Solid Solution Powders]

Oxide solid solution powders in which $ZrO_2$ and $La_2O_3$ are dissolved as a solid solution are then fabricated by subjecting powders of the hydroxide to heat treatment.

An atmosphere for heat treatment is not limited to air atmosphere. The hydroxide should only be dehydrated and an atmosphere of nitrogen, argon, or vacuum may be applicable.

In consideration of aggregation or burning of oxide solid solution powders, adjustment of a granularity of the powders, or capability or productivity of a furnace, a temperature for heat treatment is preferably from 500 to 1500° C.

Obtained powders of the oxide solid solution have a purity not lower than 99 mass % and a particle size approximately from 1 to 10 μm. The particle size of the oxide solid solution powders is measured by laser diffraction (also in other Examples).

[Step of Fabricating Mixed Powders of Powders of Oxide Solid Solution and Tungsten Powders]

Mixed powders can be fabricated by a method common as a method of manufacturing tungsten such as mixing with the use of a mixer or a mortar.

Though general tungsten powders at a purity of 99.9 mass % (3 N) are used in the present Example, lowering in melting point of a tungsten-based material can be prevented and wear of an electrode can be lessened by using high-purity tungsten powders low in metal impurity content.

[Step of Fabricating Compact]

The mixed powders are then press-formed by a method common as a method of manufacturing tungsten, such as die pressing or cold isostatic pressing (CIP), to thereby make a compact (which is also referred to as a "pressed material").

A pressure for pressing is desirably set to a generally used pressure from 98 MPa to 588 MPa, in consideration of ability to hold a shape of a compact or a density of a sintered material. In order to obtain strength necessary for handling of a pressed material, preparatory sintering may be performed as appropriate.

[Step of Fabricating Sintered Material]

A sintered material is then fabricated by sintering the compact in a non-oxidizing atmosphere.

A sintered material having a relative density not lower than 95% is obtained by sintering the compact at a temperature not lower than 1750° C. In consideration of productivity of the sintered material, a sintering temperature of 1800° C. is desirably adopted, and in consideration of further denseness, a sintering temperature not lower than 2000° C. is desirably adopted.

The upper limit of the sintering temperature is set to be lower than the melting point of tungsten in consideration of maintaining a shape of the compact.

Any of sintering by indirect heating or sintering by direct electric current activated heating can be employed as a sintering method. In general, in the former example, the temperature is not higher than 2400° C. due to restriction on an apparatus, and in the latter example, the temperature is not higher than 3000° C.

An atmosphere during sintering can be selected as appropriate from among a general hydrogen gas reducing atmosphere, an argon inert atmosphere, and vacuum. A temperature and a time period for sintering are not limited to conditions which will be described later in Examples, and can be set as appropriate in consideration of a required density of a sintered material or workability in next plastic working.

[Step of Fabricating Tungsten Rod Material (which is Also Referred to as a Rod-Shaped Material or a Columnar Material)]

A tungsten rod material is fabricated by plastically working the sintered material such that a relative density thereof is generally not lower than 98%. This is because the electrode is required to have mechanical characteristics. Plastic working, however, is not essential, and a near net shape of an electrode can also be fabricated from a sintered material and used for the electrode.

A method common as a method of manufacturing a tungsten electrode material such as hot swaging, hot drawing, or hot rolling can be employed for plastic working.

<Fabrication Method According to Manufacturing Method in FIG. 4>

The present method is a fabrication method using tungsten oxide powders instead of tungsten powders used in FIG. 3. In particular, a difference from the fabrication method in FIG. 3 resides in [Step of Fabricating Powders of Oxide Solid Solution].

This method will be described below with reference to an example of Zr and La.

[Step of Fabricating Hydroxide Precipitate]

Initially, a hydroxide precipitate of a Zr hydroxide and an La hydroxide is fabricated by the coprecipitation method described in the fabrication method in FIG. 3.

[Step of Fabricating Powders of Hydroxide]

Dried powders are fabricated by using the fabrication method described in the fabrication method in FIG. 3.

[Step of Fabricating Mixture]

A mixture is then fabricated by mixing the obtained powders of the hydroxide and the tungsten oxide powders. Regarding a purity of the tungsten oxide, a purity of tungsten except for oxygen is not lower than 99.9 mass %. A particle size from 1 to 10 μm (measured by a Fisher (Fsss) method) is preferred.

The mixture can be fabricated by mixing by a method common as a tungsten manufacturing method, such as a mixer.

[Step of Fabricating Oxide Solid Solution Powders]

In parallel to reduction treatment of the mixture in a hydrogen atmosphere to reduce tungsten oxide powders to tungsten powders, powders of the hydroxides of Zr and La which are precursors of an oxide solid solution are converted to oxide solid solution powders. Mixed powders of the tungsten powders and the oxide solid solution powders are thus fabricated.

In consideration of adjustment of aggregation or granularity of the oxide solid solution powders, burning, reduction of a tungsten oxide, or capability or productivity of a furnace, a reduction temperature is preferably from 800 to 1000° C.

Tungsten powders for a tungsten electrode are reduced generally at a temperature from 800 to 1000° C. and the precursor fabricated in the step in FIG. 4 showing the present fabrication method or FIG. 5 which will be described later can completely be converted to a solid solution in a reduction step.

Tungsten trioxide ($WO_3$), blue oxide (of which representative composition formula is $W_4O_{11}$), or tungsten dioxide ($WO_2$) can also be employed as a tungsten oxide.

[Step of Fabricating Compact], [Step of Fabricating Sintered Material], and [Step of Fabricating Tungsten Rod Material] that follow are the same as the steps described with reference to FIG. 3.

<Fabrication Method According to Manufacturing Method in FIG. 5>

The present method is a fabrication method as in FIG. 4 which uses tungsten oxide powders instead of tungsten powders in FIG. 3.

This method will be described below with reference to an example of Zr and La. [Step of Doping (Mixing) Tungsten Oxide Powders with Solid Solution Precursor]

Initially, a solution in which a Zr chloride and an La chloride are dissolved in water at a prescribed ratio is fabricated as a precursor of an oxide solid solution and the solution is mixed with powders of a tungsten oxide.

A mixture may be fabricated by using a nitrate or a sulfate instead of a chloride, increasing a concentration of the solution, or diluting the aqueous solution with ethyl alcohol.

Mixing is performed by a general method with the use of a mixer which is used for manufacturing tungsten.

Then, tungsten oxide powders are fabricated by mixing and drying the mixture by heating the mixture at a temperature approximately from 100° C. to 250° C.

A method the same as in [Step of Fabricating Powders of Hydroxide] in FIG. 3 is used for drying.

Though moisture is preferably completely removed, it is removed also in a next hydrogen reduction step.

[Step of Fabricating Powders of Oxide Solid Solution]

In parallel to reduction treatment of the mixture in a hydrogen atmosphere as in the fabrication method in FIG. 4 to convert tungsten oxide powders into tungsten powders, powders of a solid solution of oxides $ZrO_2$ and $La_2O_3$ are formed. Mixed powders of tungsten powders and oxide solid solution powders are thus fabricated. A tungsten oxide to be used is manufactured by the fabrication method in FIG. 4. It is tungsten that is obtained by reduction treatment in the hydrogen atmosphere, and a simple metal substance of Zr or La cannot be obtained. $ZrO_2$ and $La_2O_3$ are generated.

[Step of Fabricating Compact], [Step of Fabricating Sintered Material], and [Step of Fabricating Tungsten Rod Material] that follow are the same as the steps described with reference to FIG. 3.

A tungsten electrode material in which particles of an oxide solid solution are finally dispersed in a tungsten electrode material can also be fabricated by mixing with tungsten powders, a solution as a precursor of an oxide solid solution in which a Zr chloride and an La chloride are dissolved at a prescribed ratio or by mixing oxide solid solution powders fabricated in advance with tungsten oxide powders, other than the fabrication methods in FIGS. 3 to 5.

Details of Embodiment of the Present Invention

The tungsten electrode material according to the present invention will be described in further detail below with reference to specific Examples.

Initially, tungsten electrode materials for evaluation samples shown in Examples 1 to 26 below were initially fabricated by the method in FIG. 3.

Example 1

A weight ratio between a Zr chloride and an La chloride (manufactured by Aldrich and having a purity of 99.9 mass %) was set such that 34 mol % of $ZrO_2$ and 66 mol % of $La_2O_3$ were contained, the chlorides were dissolved in water, and a concentration was adjusted to 0.2 mol/dm$^3$. While the obtained aqueous solution was stirred, 2 mol/dm$^3$ of ammonia water were dropped into the aqueous solution. The ammonia water was dropped until the aqueous solution exhibits pH 8, and a hydroxide precipitate of Zr and La was obtained.

Then, the hydroxide precipitate was dried at 200° C. and the dried hydroxide precipitate was roasted in air atmosphere at 1000° C. to thereby obtain oxide solid solution powders. The powders were confirmed as solid solution powders of $ZrO_2$ and $La_2O_3$ by X-ray diffraction. The obtained oxide solid solution had a particle size approximately from 1 to 10 μm.

Then, $ZrO_2$ (34 mol %)-$La_2O_3$ (66 mol %) oxide solid solution powders were mixed with general tungsten powders having a purity not lower than 99.9 mass % and an average particle size of approximately 4 μm (measured by the Fisher (Fsss) method), and the obtained tungsten powders were die-pressed at 196 MPa to thereby obtain a columnar compact having a diameter of 30 mm×a height of 20 mm. A mixed amount of the oxide was adjusted to finally achieve a content of 1.5 mass % in the tungsten electrode material.

Then, the tungsten electrode material according to the present invention was fabricated by performing sintering for ten hours in a hydrogen atmosphere at 1800° C. The obtained columnar sintered material had a relative density of approximately 95%. The tungsten electrode material of the sintered material can be fabricated by performing a step of forming such as cutting onto the sintered material. A rod-shaped tungsten electrode material can be fabricated by performing [Step of Fabricating Tungsten Rod Material] onto the sintered material. In Example 1, a rod-shaped tungsten electrode material was fabricated.

Example 2

A tungsten electrode material was fabricated in the fabrication procedure in Example 1 except for fabrication of the oxide solid solution such that 30 mol % of $ZrO_2$ and 70 mol % of $La_2O_3$ were contained.

Example 3

A tungsten electrode material was fabricated in the fabrication procedure in Example 1 except for fabrication of the oxide solid solution such that 20 mol % of $ZrO_2$ and 80 mol % of $La_2O_3$ were contained and adjustment of a mixed amount of the oxide to finally achieve a content of 0.5 mass % in the tungsten electrode material.

Example 4

A tungsten electrode material was fabricated in the fabrication procedure in Example 3 except for fabrication of the oxide solid solution such that 20 mol % of $ZrO_2$ and 80 mol % of $La_2O_3$ were contained and adjustment of a mixed amount of the oxide to finally achieve a content of 0.8 mass % in the tungsten electrode material.

Example 5

A tungsten electrode material was fabricated in the fabrication procedure in Example 3 except for fabrication of the oxide solid solution such that 20 mol % of $ZrO_2$ and 80 mol % of $La_2O_3$ were contained and adjustment of a mixed amount of the oxide to finally achieve a content of 1.5 mass % in the tungsten electrode material.

Example 6

A tungsten electrode material was fabricated in the fabrication procedure in Example 3 except for fabrication of the oxide solid solution such that 20 mol % of $ZrO_2$ and 80 mol % of $La_2O_3$ were contained and adjustment of a mixed amount of the oxide to finally achieve a content of 3.0 mass % in the tungsten electrode material.

Example 7

A tungsten electrode material was fabricated in the fabrication procedure in Example 3 except for fabrication of the oxide solid solution such that 20 mol % of $ZrO_2$ and 80 mol % of $La_2O_3$ were contained and adjustment of a mixed amount of the oxide to finally achieve a content of 5.0 mass % in the tungsten electrode material.

Example 8

A sintered tungsten electrode material was fabricated in the fabrication procedure in Example 1 except for fabrication of the oxide solid solution such that 20 mol % of $ZrO_2$ and 80 mol % of $La_2O_3$ were contained and adjustment of a mixed amount of the oxide to finally achieve a content of 6.0 mass % in the tungsten electrode material.

Example 9

A tungsten electrode material was fabricated in the fabrication procedure in Example 1 except for fabrication of the oxide solid solution such that 5 mol % of $ZrO_2$ and 95 mol % of $La_2O_3$ were contained and adjustment of a mixed amount of the oxide to finally achieve a content of 1.5 mass % in the tungsten electrode material.

Example 10

A tungsten electrode material was fabricated in the fabrication procedure in Example 1 except for fabrication of the oxide solid solution such that 3 mol % of $ZrO_2$ and 97 mol % of $La_2O_3$ were contained and adjustment of a mixed amount of the oxide to finally achieve a content of 1.5 mass % in the tungsten electrode material.

Example 11

A tungsten electrode material as a sintered material was fabricated in the fabrication procedure in Example 1 by fabricating the oxide solid solution such that 20 mol % of $ZrO_2$ and 80 mol % of $La_2O_3$ were contained and adjusting a mixed amount of the oxide to finally achieve a content of 8.0 mass % in the tungsten electrode material.

Example 12

A tungsten electrode material as a sintered material was fabricated in the fabrication procedure in Example 1 by fabricating the oxide solid solution such that 20 mol % of $ZrO_2$ and 80 mol % of $La_2O_3$ were contained and adjusting a mixed amount of the oxide to finally achieve a content of 9.0 mass % in the tungsten electrode material.

Table 2 shows these contents.

TABLE 2

| Sample for Evaluation (Example) | Molar Ratio of Zirconium (equal to $ZrO_2$: mol %) | Molar Ratio of Lanthanum (equal to $La_2O_3$: mol %) | Content of Oxide Solid Solution ($ZrO_2$—$La_2O_3$) in Tungsten Electrode Material (mass %) |
|---|---|---|---|
| 1 | 34 | 66 | 1.5 |
| 2 | 30 | 70 | 1.5 |
| 3 | 20 | 80 | 0.5 |
| 4 | 20 | 80 | 0.8 |
| 5 | 20 | 80 | 1.5 |
| 6 | 20 | 80 | 3.0 |
| 7 | 20 | 80 | 5.0 |
| 8 | 20 | 80 | 6.0 |
| 9 | 5 | 95 | 1.5 |
| 10 | 3 | 97 | 1.5 |
| 11 | 20 | 80 | 8.0 |
| 12 | 20 | 80 | 9.0 |

Example 13

A tungsten electrode material was fabricated in the fabrication procedure in Example 1 except for fabrication of the oxide solid solution such that 34 mol % of $ZrO_2$ and 66 mol % of $Nd_2O_3$ were contained and adjustment of a mixed amount of the oxide to finally achieve a content of 1.5 mass % in the tungsten electrode material.

Example 14

A tungsten electrode material was fabricated in the fabrication procedure in Example 1 except for fabrication of the oxide solid solution such that 30 mol % of $ZrO_2$ and 70 mol % of $Nd_2O_3$ were contained and adjustment of a mixed amount of the oxide to finally achieve a content of 1.5 mass % in the tungsten electrode material.

Example 15

A tungsten electrode material was fabricated in the fabrication procedure in Example 1 except for fabrication of the oxide solid solution such that 20 mol % of $ZrO_2$ and 80 mol % of $Nd_2O_3$ were contained and adjustment of a mixed amount of the oxide to finally achieve a content of 1.5 mass % in the tungsten electrode material.

Example 16

A tungsten electrode material was fabricated in the fabrication procedure in Example 1 except for fabrication of the oxide solid solution such that 5 mol % of $ZrO_2$ and 95 mol % of $Nd_2O_3$ were contained and adjustment of a mixed amount of the oxide to finally achieve a content of 1.5 mass % in the tungsten electrode material.

Example 17

A tungsten electrode material was fabricated in the fabrication procedure in Example 1 except for fabrication of the oxide solid solution such that 3 mol % of $ZrO_2$ and 97 mol % of $Nd_2O_3$ were contained and adjustment of a mixed amount of the oxide to finally achieve a content of 1.5 mass % in the tungsten electrode material.

Example 18

A tungsten electrode material was fabricated in the fabrication procedure in Example 1 except for fabrication of the oxide solid solution such that 20 mol % of $ZrO_2$ and 80 mol % of $Nd_2O_3$ were contained and adjustment of a mixed amount of the oxide to finally achieve a content of 0.5 mass % in the tungsten electrode material.

Example 19

A tungsten electrode material was fabricated in the fabrication procedure in Example 1 except for fabrication of the oxide solid solution such that 20 mol % of $ZrO_2$ and 80 mol % of $Nd_2O_3$ were contained and adjustment of a mixed amount of the oxide to finally achieve a content of 0.8 mass % in the tungsten electrode material.

Example 20

A tungsten electrode material was fabricated in the fabrication procedure in Example 1 except for fabrication of the oxide solid solution such that 20 mol % of $ZrO_2$ and 80 mol % of $Nd_2O_3$ were contained and adjustment of a mixed amount of the oxide to finally achieve a content of 3.0 mass % in the tungsten electrode material.

Example 21

A tungsten electrode material was fabricated in the fabrication procedure in Example 1 except for fabrication of the oxide solid solution such that 20 mol % of $ZrO_2$ and 80 mol % of $Nd_2O_3$ were contained and adjustment of a mixed amount of the oxide to finally achieve a content of 5.0 mass % in the tungsten electrode material.

Example 22

A tungsten electrode material as a sintered material was fabricated in the fabrication procedure in Example 1 except for fabrication of the oxide solid solution such that 20 mol % of $ZrO_2$ and 80 mol % of $Nd_2O_3$ were contained and adjustment of a mixed amount of the oxide to finally achieve a content of 6.0 mass % in the tungsten electrode material.

Example 23

A tungsten electrode material as a sintered material was fabricated in the fabrication procedure in Example 1 except for fabrication of the oxide solid solution such that 20 mol % of $ZrO_2$ and 80 mol % of $Nd_2O_3$ were contained and adjustment of a mixed amount of the oxide to finally achieve a content of 8.0 mass % in the tungsten electrode material.

Example 24

A tungsten electrode material as a sintered material was fabricated in the fabrication procedure in Example 1 except for fabrication of the oxide solid solution such that 20 mol % of $ZrO_2$ and 80 mol % of $Nd_2O_3$ were contained and adjustment of a mixed amount of the oxide to finally achieve a content of 9.0 mass % in the tungsten electrode material.

Table 3 shows these contents.

TABLE 3

| Sample for Evaluation (Example) | Molar Ratio of Zirconium (equal to $ZrO_2$: mol %) | Molar Ratio of Neodymium (equal to $Nd_2O_3$: mol %) | Content of Oxide Solid Solution ($ZrO_2$—$Nd_2O_3$) in Tungsten Electrode Material (mass %) |
|---|---|---|---|
| 13 | 34 | 66 | 1.5 |
| 14 | 30 | 70 | 1.5 |
| 15 | 20 | 80 | 1.5 |
| 16 | 5 | 95 | 1.5 |
| 17 | 3 | 97 | 1.5 |
| 18 | 20 | 80 | 0.5 |
| 19 | 20 | 80 | 0.8 |
| 20 | 20 | 80 | 3.0 |
| 21 | 20 | 80 | 5.0 |
| 22 | 20 | 80 | 6.0 |
| 23 | 20 | 80 | 8.0 |
| 24 | 20 | 80 | 9.0 |

Example 25

A tungsten electrode material was fabricated in the fabrication procedure in Example 1 except for fabrication of the oxide solid solution such that 10 mol % of $ZrO_2$ and 90 mol % of $CeO_2$ were contained and adjustment of a mixed amount of the oxide to finally achieve a content of 1.5 mass % in the tungsten electrode material.

Example 26

A tungsten electrode material was fabricated in the fabrication procedure in Example 1 except for fabrication of the oxide solid solution such that 20 mol % of $HfO_2$ and 80 mol % of $La_2O_3$ were contained and adjustment of a mixed amount of the oxide to finally achieve a content of 1.5 mass % in the tungsten electrode material.

Table 4 shows these contents.

TABLE 4

| Sample for Evaluation (Example) | Molar Ratio of Zirconium (equal to $ZrO_2$: mol %) | Molar Ratio of Cerium (equal to $CeO_2$: mol %) | Content of Oxide Solid Solution ($ZrO_2$—$CeO_2$) in Tungsten Electrode Material (mass %) |
|---|---|---|---|
| 25 | 10 | 90 | 1.5 |
| **Sample for Evaluation (Example)** | **Molar Ratio of Hafnium (equal to $HfO_2$: mol %)** | **Molar Ratio of Lanthanum (equal to $La_2O_3$: mol %)** | **Content of Oxide Solid Solution ($HfO_2$—$La_2O_3$) in Tungsten Electrode Material (mass %)** |
| 26 | 20 | 80 | 1.5 |

Example 27

A tungsten electrode material was fabricated in the fabrication procedure in Example 1 except for fabrication of the oxide solid solution such that 10 mol % of $ZrO_2$ and 90 mol % of $Sc_2O_3$ were contained.

Example 28

A tungsten electrode material was fabricated in the fabrication procedure in Example 1 except for fabrication of the oxide solid solution such that 10 mol % of $ZrO_2$ and 90 mol % of $Sm_2O_3$ were contained.

Example 29

A tungsten electrode material was fabricated in the fabrication procedure in Example 1 except for fabrication of the oxide solid solution such that 10 mol % of $ZrO_2$ and 90 mol % of $Eu_2O_3$ were contained.

Example 30

A tungsten electrode material was fabricated in the fabrication procedure in Example 1 except for fabrication of the oxide solid solution such that 10 mol % of $ZrO_2$ and 90 mol % of $Tb_2O_3$ were contained.

Example 31

A tungsten electrode material was fabricated in the fabrication procedure in Example 1 except for fabrication of the oxide solid solution such that 10 mol % of $ZrO_2$ and 90 mol % of $Dy_2O_3$ were contained.

Example 32

A tungsten electrode material was fabricated in the fabrication procedure in Example 1 except for fabrication of the oxide solid solution such that 10 mol % of $ZrO_2$ and 90 mol % of $Ho_2O_3$ were contained.

Example 33

A tungsten electrode material was fabricated in the fabrication procedure in Example 1 except for fabrication of the oxide solid solution such that 10 mol % of $ZrO_2$ and 90 mol % of $Er_2O_3$ were contained.

Example 34

A tungsten electrode material was fabricated in the fabrication procedure in Example 1 except for fabrication of the oxide solid solution such that 10 mol % of $ZrO_2$ and 90 mol % of $Tm_2O_3$ were contained.

Example 35

A tungsten electrode material was fabricated in the fabrication procedure in Example 1 except for fabrication of the oxide solid solution such that 10 mol % of $ZrO_2$ and 90 mol % of $Yb_2O_3$ were contained.

Example 36

A tungsten electrode material was fabricated in the fabrication procedure in Example 1 except for fabrication of the oxide solid solution such that 34 mol % of $ZrO_2$ and 66 mol % of $CeO_2$ were contained.

Example 37

A tungsten electrode material was fabricated in the fabrication procedure in Example 1 except for fabrication of the oxide solid solution such that 30 mol % of $ZrO_2$ and 70 mol % of $CeO_2$ were contained.

Example 38

A tungsten electrode material was fabricated in the fabrication procedure in Example 1 except for fabrication of the oxide solid solution such that 20 mol % of $ZrO_2$ and 80 mol % of $CeO_2$ were contained.

Example 39

A tungsten electrode material was fabricated in the fabrication procedure in Example 1 except for fabrication of the oxide solid solution such that 5 mol % of $ZrO_2$ and 95 mol % of $CeO_2$ were contained.

Example 40

A tungsten electrode material was fabricated in the fabrication procedure in Example 1 except for fabrication of the oxide solid solution such that 3 mol % of $ZrO_2$ and 97 mol % of $CeO_2$ were contained.

Example 41

A tungsten electrode material was fabricated in the fabrication procedure in Example 1 except for fabrication of the oxide solid solution such that 20 mol % of $ZrO_2$ and 80 mol % of $CeO_2$ were contained and adjustment of a mixed amount of the oxide to finally achieve a content of 0.5 mass % in the tungsten electrode material.

Example 42

A tungsten electrode material was fabricated in the fabrication procedure in Example 41 except for adjustment of a mixed amount of the oxide to finally achieve a content of 0.8 mass % in the tungsten electrode material.

Example 43

A tungsten electrode material was fabricated in the fabrication procedure in Example 41 except for adjustment of a mixed amount of the oxide to finally achieve a content of 3 mass % in the tungsten electrode material.

Example 44

A tungsten electrode material was fabricated in the fabrication procedure in Example 41 except for adjustment of a mixed amount of the oxide to finally achieve a content of 5 mass % in the tungsten electrode material.

Example 45

A tungsten electrode material was fabricated in the fabrication procedure in Example 41 except for adjustment of a mixed amount of the oxide to finally achieve a content of 6 mass % in the tungsten electrode material.

Example 46

A tungsten electrode material was fabricated in the fabrication procedure in Example 41 except for adjustment of a mixed amount of the oxide to finally achieve a content of 8 mass % in the tungsten electrode material.

Example 47

A tungsten electrode material was fabricated in the fabrication procedure in Example 41 except for adjustment of a mixed amount of the oxide to finally achieve a content of 9 mass % in the tungsten electrode material.

Example 48

A tungsten electrode material was fabricated in the fabrication procedure in Example 1 except for fabrication of the oxide solid solution such that 34 mol % of $ZrO_2$ and 66 mol % of $Y_2O_3$ were contained.

Example 49

A tungsten electrode material was fabricated in the fabrication procedure in Example 1 except for fabrication of the oxide solid solution such that 30 mol % of $ZrO_2$ and 70 mol % of $Y_2O_3$ were contained.

Example 50

A tungsten electrode material was fabricated in the fabrication procedure in Example 1 except for fabrication of the oxide solid solution such that 20 mol % of $ZrO_2$ and 80 mol % of $Y_2O_3$ were contained.

Example 51

A tungsten electrode material was fabricated in the fabrication procedure in Example 1 except for fabrication of the oxide solid solution such that 5 mol % of $ZrO_2$ and 95 mol % of $Y_2O_3$ were contained.

Example 52

A tungsten electrode material was fabricated in the fabrication procedure in Example 1 except for fabrication of the oxide solid solution such that 3 mol % of $ZrO_2$ and 97 mol % of $Y_2O_3$ were contained.

Example 53

A tungsten electrode material was fabricated in the fabrication procedure in Example 1 except for fabrication of the oxide solid solution such that 20 mol % of $ZrO_2$ and 80 mol % of $Y_2O_3$ were contained and adjustment of a mixed amount of the oxide to finally achieve a content of 0.5 mass % in the tungsten electrode material.

Example 54

A tungsten electrode material was fabricated in the fabrication procedure in Example 53 except for adjustment of a mixed amount of the oxide to finally achieve a content of 0.8 mass % in the tungsten electrode material.

Example 55

A tungsten electrode material was fabricated in the fabrication procedure in Example 53 except for adjustment of a mixed amount of the oxide to finally achieve a content of 3 mass % in the tungsten electrode material.

Example 56

A tungsten electrode material was fabricated in the fabrication procedure in Example 53 except for adjustment of a mixed amount of the oxide to finally achieve a content of 5 mass % in the tungsten electrode material.

Example 57

A tungsten electrode material was fabricated in the fabrication procedure in Example 53 except for adjustment of a mixed amount of the oxide to finally achieve a content of 6 mass % in the tungsten electrode material.

Example 58

A tungsten electrode material was fabricated in the fabrication procedure in Example 53 except for adjustment of a mixed amount of the oxide to finally achieve a content of 8 mass % in the tungsten electrode material.

Example 59

A tungsten electrode material was fabricated in the fabrication procedure in Example 53 except for adjustment of an amount of mixed oxide to finally achieve a content of 9 mass % in the tungsten electrode material.

Example 60

A tungsten electrode material was fabricated in the fabrication procedure in Example 1 except for fabrication of the oxide solid solution such that 34 mol % of $ZrO_2$ and 66 mol % of $Pr_2O_3$ were contained.

Example 61

A tungsten electrode material was fabricated in the fabrication procedure in Example 1 except for fabrication of the oxide solid solution such that 30 mol % of $ZrO_2$ and 70 mol % of $Pr_2O_3$ were contained.

Example 62

A tungsten electrode material was fabricated in the fabrication procedure in Example 1 except for fabrication of the oxide solid solution such that 20 mol % of $ZrO_2$ and 80 mol % of $Pr_2O_3$ were contained.

Example 63

A tungsten electrode material was fabricated in the fabrication procedure in Example 1 except for fabrication of the oxide solid solution such that 5 mol % of $ZrO_2$ and 95 mol % of $Pr_2O_3$ were contained.

Example 64

A tungsten electrode material was fabricated in the fabrication procedure in Example 1 except for fabrication of the oxide solid solution such that 3 mol % of $ZrO_2$ and 97 mol % of $Pr_2O_3$ were contained.

Example 65

A tungsten electrode material was fabricated in the fabrication procedure in Example 1 except for fabrication of the oxide solid solution such that 20 mol % of $ZrO_2$ and 80 mol % of $Pr_2O_3$ were contained and adjustment of an amount of mixed oxide to finally achieve a content of 0.5 mass % in the tungsten electrode material.

Example 66

A tungsten electrode material was fabricated in the fabrication procedure in Example 65 except for adjustment of a mixed amount of the oxide to finally achieve a content of 0.8 mass % in the tungsten electrode material.

Example 67

A tungsten electrode material was fabricated in the fabrication procedure in Example 65 except for adjustment of a mixed amount of the oxide to finally achieve a content of 3 mass % in the tungsten electrode material.

Example 68

A tungsten electrode material was fabricated in the fabrication procedure in Example 65 except for adjustment of a mixed amount of the oxide to finally achieve a content of 5 mass % in the tungsten electrode material.

Example 69

A tungsten electrode material was fabricated in the fabrication procedure in Example 65 except for adjustment of a mixed amount of the oxide to finally achieve a content of 6 mass % in the tungsten electrode material.

Example 70

A tungsten electrode material was fabricated in the fabrication procedure in Example 65 except for adjustment of a mixed amount of the oxide to finally achieve a content of 8 mass % in the tungsten electrode material.

Example 71

A tungsten electrode material was fabricated in the fabrication procedure in Example 65 except for adjustment of a mixed amount of the oxide to finally achieve a content of 9 mass % in the tungsten electrode material.

Example 72

A tungsten electrode material was fabricated in the fabrication procedure in Example 1 except for fabrication of the oxide solid solution such that 34 mol % of $ZrO_2$ and 66 mol % of $Gd_2O_3$ were contained.

Example 73

A tungsten electrode material was fabricated in the fabrication procedure in Example 1 except for fabrication of the oxide solid solution such that 30 mol % of $ZrO_2$ and 70 mol % of $Gd_2O_3$ were contained.

Example 74

A tungsten electrode material was fabricated in the fabrication procedure in Example 1 except for fabrication of the oxide solid solution such that 20 mol % of $ZrO_2$ and 80 mol % of $Gd_2O_3$ were contained.

Example 75

A tungsten electrode material was fabricated in the fabrication procedure in Example 1 except for fabrication of the oxide solid solution such that 5 mol % of $ZrO_2$ and 95 mol % of $Gd_2O_3$ were contained.

Example 76

A tungsten electrode material was fabricated in the fabrication procedure in Example 1 except for fabrication of the oxide solid solution such that 3 mol % of $ZrO_2$ and 97 mol % of $Gd_2O_3$ were contained.

Example 77

A tungsten electrode material was fabricated in the fabrication procedure in Example 1 except for fabrication of the oxide solid solution such that 20 mol % of $ZrO_2$ and 80 mol % of $Gd_2O_3$ were contained and adjustment of a mixed amount of the oxide to finally achieve a content of 0.5 mass % in the tungsten electrode material.

Example 78

A tungsten electrode material was fabricated in the fabrication procedure in Example 77 except for adjustment of a mixed amount of the oxide to finally achieve a content of 0.8 mass % in the tungsten electrode material.

Example 79

A tungsten electrode material was fabricated in the fabrication procedure in Example 77 except for adjustment of a mixed amount of the oxide to finally achieve a content of 3 mass % in the tungsten electrode material.

Example 80

A tungsten electrode material was fabricated in the fabrication procedure in Example 77 except for adjustment of a mixed amount of the oxide to finally achieve a content of 5 mass % in the tungsten electrode material.

Example 81

A tungsten electrode material was fabricated in the fabrication procedure in Example 77 except for adjustment of a mixed amount of the oxide to finally achieve a content of 6 mass % in the tungsten electrode material.

Example 82

A tungsten electrode material was fabricated in the fabrication procedure in Example 77 except for adjustment of a mixed amount of the oxide to finally achieve a content of 8 mass % in the tungsten electrode material.

Example 83

A tungsten electrode material was fabricated in the fabrication procedure in Example 77 except for adjustment of a mixed amount of the oxide to finally achieve a content of 9 mass % in the tungsten electrode material.

Example 84

A tungsten electrode material was fabricated in the fabrication procedure in Example 1 except for fabrication of the oxide solid solution such that 34 mol % of $ZrO_2$ and 66 mol % of $Lu_2O_3$ were contained.

Example 85

A tungsten electrode material was fabricated in the fabrication procedure in Example 1 except for fabrication of the oxide solid solution such that 30 mol % of $ZrO_2$ and 70 mol % of $Lu_2O_3$ were contained.

Example 86

A tungsten electrode material was fabricated in the fabrication procedure in Example 1 except for fabrication of the oxide solid solution such that 20 mol % of $ZrO_2$ and 80 mol % of $Lu_2O_3$ were contained.

Example 87

A tungsten electrode material was fabricated in the fabrication procedure in Example 1 except for fabrication of the oxide solid solution such that 5 mol % of $ZrO_2$ and 95 mol % of $Lu_2O_3$ were contained.

Example 88

A tungsten electrode material was fabricated in the fabrication procedure in Example 1 except for fabrication of the oxide solid solution such that 3 mol % of $ZrO_2$ and 97 mol % of $Lu_2O_3$ were contained.

Example 89

A tungsten electrode material was fabricated in the fabrication procedure in Example 1 except for fabrication of the oxide solid solution such that 20 mol % of $ZrO_2$ and 80 mol % of $Lu_2O_3$ were contained and adjustment of a mixed amount of the oxide to finally achieve a content of 0.5 mass % in the tungsten electrode material.

Example 90

A tungsten electrode material was fabricated in the fabrication procedure in Example 89 except for adjustment of a mixed amount of the oxide to finally achieve a content of 0.8 mass % in the tungsten electrode material.

Example 91

A tungsten electrode material was fabricated in the fabrication procedure in Example 89 except for adjustment of a mixed amount of the oxide to finally achieve a content of 3 mass % in the tungsten electrode material.

Example 92

A tungsten electrode material was fabricated in the fabrication procedure in Example 89 except for adjustment of a mixed amount of the oxide to finally achieve a content of 5 mass % in the tungsten electrode material.

Example 93

A tungsten electrode material was fabricated in the fabrication procedure in Example 89 except for adjustment of a mixed amount of the oxide to finally achieve a content of 6 mass % in the tungsten electrode material.

Example 94

A tungsten electrode material was fabricated in the fabrication procedure in Example 89 except for adjustment of a mixed amount of the oxide to finally achieve a content of 8 mass % in the tungsten electrode material.

Example 95

A tungsten electrode material was fabricated in the fabrication procedure in Example 89 except for adjustment of a mixed amount of the oxide to finally achieve a content of 9 mass % in the tungsten electrode material.

Comparative Example 1

A tungsten electrode material was fabricated in the fabrication procedure in Example 1 except for fabrication of the oxide solid solution such that 70 mol % of $ZrO_2$ and 30 mol % of $La_2O_3$ were contained.

Comparative Example 2

A tungsten electrode material was fabricated in the fabrication procedure in Example 1 except for fabrication of the oxide solid solution such that 40 mol % of $ZrO_2$ and 60 mol % of $La_2O_3$ were contained.

Comparative Example 3

A tungsten electrode material was fabricated in the fabrication procedure in Example 1 except for fabrication of the oxide solid solution such that 1 mol % of $ZrO_2$ and 99 mol % of $La_2O_3$ were contained.

Comparative Example 4

A tungsten electrode material was fabricated in the fabrication procedure in Example 3 except for fabrication of the oxide solid solution such that 20 mol % of $ZrO_2$ and 80 mol % of $La_2O_3$ were contained and adjustment of a mixed amount of the oxide to finally achieve a content of 0.1 mass % in the tungsten electrode material.

Comparative Example 5

Though an attempt to fabricate a tungsten electrode material as a sintered material in the fabrication procedure in Example 1 was made by fabricating the oxide solid solution such that 20 mol % of $ZrO_2$ and 80 mol % of $La_2O_3$ were contained and adjusting a mixed amount of the oxide to finally achieve a content of 10 mass % in the tungsten electrode material, fabrication failed.

Table 5 shows these contents.

TABLE 5

| Sample for Evaluation (Comparative Example) | Molar Ratio of Zirconium (equal to $ZrO_2$: mol %) | Molar Ratio of Lanthanum (equal to $La_2O_3$: mol %) | Content of Oxide Solid Solution in Tungsten Electrode Material (mass %) |
|---|---|---|---|
| 1 | 70 | 30 | 1.5 |
| 2 | 40 | 60 | 1.5 |
| 3 | 1 | 99 | 1.5 |
| 4 | 20 | 80 | 0.1 |
| 5 | 20 | 80 | 10 |

Comparative Example 6

A tungsten electrode material was fabricated in the fabrication procedure in Example 1 except for fabrication of the oxide solid solution such that 70 mol % of $ZrO_2$ and 30 mol % of $Nd_2O_3$ were contained and adjustment of a mixed amount of the oxide to finally achieve a content of 1.5 mass % in the tungsten electrode material.

Comparative Example 7

A tungsten electrode material was fabricated in the fabrication procedure in Example 1 except for fabrication of the oxide solid solution such that 40 mol % of $ZrO_2$ and 60 mol % of $Nd_2O_3$ were contained and adjustment of a mixed amount of the oxide to finally achieve a content of 1.5 mass % in the tungsten electrode material.

Comparative Example 8

A tungsten electrode material was fabricated in the fabrication procedure in Example 1 except for fabrication of the oxide solid solution such that 1 mol % of $ZrO_2$ and 99 mol % of $Nd_2O_3$ were contained and adjustment of a mixed amount of the oxide to finally achieve a content of 1.5 mass % in the tungsten electrode material.

Comparative Example 9

A tungsten electrode material was fabricated in the fabrication procedure in Example 1 except for fabrication of the oxide solid solution such that 20 mol % of $ZrO_2$ and 80 mol % of $Nd_2O_3$ were contained and adjustment of a mixed amount of the oxide to finally achieve a content of 0.1 mass % in the tungsten electrode material.

Comparative Example 10

Though an attempt to fabricate a tungsten electrode material as a sintered material in the fabrication procedure in Example 1 was made by fabricating the oxide solid solution such that 20 mol % of $ZrO_2$ and 80 mol % of $Nd_2O_3$ were contained and adjusting a mixed amount of the oxide to finally achieve a content of 10.0 mass % in the tungsten electrode material, fabrication failed.

Table 6 shows these contents.

TABLE 6

| Sample for Evaluation (Comparative Example) | Molar Ratio of Zirconium (equal to $ZrO_2$: mol %) | Molar Ratio of Neodymium (equal to $Nd_2O_3$: mol %) | Content of Oxide Solid Solution in Tungsten Electrode Material (mass %) |
|---|---|---|---|
| 6 | 70 | 30 | 1.5 |
| 7 | 40 | 60 | 1.5 |
| 8 | 1 | 99 | 1.5 |
| 9 | 20 | 80 | 0.1 |
| 10 | 20 | 80 | 10 |

Comparative Example 11

A tungsten electrode material was fabricated in the fabrication procedure in Example 1 except for fabrication of the oxide solid solution such that 70 mol % of $ZrO_2$ and 30 mol % of $CeO_2$ were contained.

Comparative Example 12

A tungsten electrode material was fabricated in the fabrication procedure in Example 1 except for fabrication of the oxide solid solution such that 40 mol % of $ZrO_2$ and 60 mol % of $CeO_2$ were contained.

Comparative Example 13

A tungsten electrode material was fabricated in the fabrication procedure in Example 1 except for fabrication of the oxide solid solution such that 1 mol % of $ZrO_2$ and 99 mol % of $CeO_2$ were contained.

Comparative Example 14

A tungsten electrode material was fabricated in the fabrication procedure in Example 1 except for fabrication of the oxide solid solution such that 20 mol % of $ZrO_2$ and 80 mol % of $CeO_2$ were contained and adjustment of a mixed amount of the oxide to finally achieve a content of 0.1 mass % in the tungsten electrode material.

Comparative Example 15

Though an attempt to fabricate a tungsten electrode material in the fabrication procedure in Comparative Example 14 was made except for adjustment of a mixed amount of the oxide to finally achieve a content of 10 mass % in the tungsten electrode material, fabrication failed.

Comparative Example 16

A tungsten electrode material was fabricated in the fabrication procedure in Example 1 except for fabrication of the oxide solid solution such that 70 mol % of $ZrO_2$ and 30 mol % of $Y_2O_3$ were contained.

Comparative Example 17

A tungsten electrode material was fabricated in the fabrication procedure in Example 1 except for fabrication of the oxide solid solution such that 40 mol % of $ZrO_2$ and 60 mol % of $Y_2O_3$ were contained.

Comparative Example 18

A tungsten electrode material was fabricated in the fabrication procedure in Example 1 except for fabrication of the oxide solid solution such that 1 mol % of $ZrO_2$ and 99 mol % of $Y_2O_3$ were contained.

Comparative Example 19

A tungsten electrode material was fabricated in the fabrication procedure in Example 1 except for fabrication of the oxide solid solution such that 20 mol % of $ZrO_2$ and 80 mol % of $Y_2O_3$ were contained and adjustment of a mixed amount of the oxide to finally achieve a content of 0.1 mass % in the tungsten electrode material.

Comparative Example 20

Though an attempt to fabricate a tungsten electrode material in the fabrication procedure in Comparative Example 19 was made except for adjustment of a mixed amount of the oxide to finally achieve a content of 10 mass % in the tungsten electrode material, fabrication failed.

Comparative Example 21

A tungsten electrode material was fabricated in the fabrication procedure in Example 1 except for fabrication of the oxide solid solution such that 70 mol % of $ZrO_2$ and 30 mol % of $Pr_2O_3$ were contained.

Comparative Example 22

A tungsten electrode material was fabricated in the fabrication procedure in Example 1 except for fabrication of the oxide solid solution such that 40 mol % of $ZrO_2$ and 60 mol % of $Pr_2O_3$ were contained.

Comparative Example 23

A tungsten electrode material was fabricated in the fabrication procedure in Example 1 except for fabrication of the oxide solid solution such that 1 mol % of $ZrO_2$ and 99 mol % of $Pr_2O_3$ were contained.

Comparative Example 24

A tungsten electrode material was fabricated in the fabrication procedure in Example 1 except for fabrication of the oxide solid solution such that 20 mol % of $ZrO_2$ and 80 mol % of $Pr_2O_3$ were contained and adjustment of a mixed amount of the oxide to finally achieve a content of 0.1 mass % in the tungsten electrode material.

Comparative Example 25

Though an attempt to fabricate a tungsten electrode material in the fabrication procedure in Comparative Example 24 was made except for adjustment of a mixed amount of the oxide to finally achieve a content of 10 mass % in the tungsten electrode material, fabrication failed.

Comparative Example 26

A tungsten electrode material was fabricated in the fabrication procedure in Example 1 except for fabrication of the oxide solid solution such that 70 mol % of $ZrO_2$ and 30 mol % of $Gd_2O_3$ were contained.

Comparative Example 27

A tungsten electrode material was fabricated in the fabrication procedure in Example 1 except for fabrication of the oxide solid solution such that 40 mol % of $ZrO_2$ and 60 mol % of $Gd_2O_3$ were contained.

Comparative Example 28

A tungsten electrode material was fabricated in the fabrication procedure in Example 1 except for fabrication of the oxide solid solution such that 1 mol % of $ZrO_2$ and 99 mol % of $Gd_2O_3$ were contained.

Comparative Example 29

A tungsten electrode material was fabricated in the fabrication procedure in Example 1 except for fabrication of the oxide solid solution such that 20 mol % of $ZrO_2$ and 80 mol % of $Gd_2O_3$ were contained and adjustment of a mixed amount of the oxide to finally achieve a content of 0.1 mass % in the tungsten electrode material.

Comparative Example 30

Though an attempt to fabricate a tungsten electrode material in the fabrication procedure in Comparative Example 29 was made except for adjustment of a mixed amount of the oxide to finally achieve a content of 10 mass % in the tungsten electrode material, fabrication failed.

Comparative Example 31

A tungsten electrode material was fabricated in the fabrication procedure in Example 1 except for fabrication of the oxide solid solution such that 70 mol % of $ZrO_2$ and 30 mol % of $Lu_2O_3$ were contained.

Comparative Example 32

A tungsten electrode material was fabricated in the fabrication procedure in Example 1 except for fabrication of the oxide solid solution such that 40 mol % of $ZrO_2$ and 60 mol % of $Lu_2O_3$ were contained.

Comparative Example 33

A tungsten electrode material was fabricated in the fabrication procedure in Example 1 except for fabrication of the oxide solid solution such that 1 mol % of $ZrO_2$ and 99 mol % of $Lu_2O_3$ were contained.

Comparative Example 34

A tungsten electrode material was fabricated in the fabrication procedure in Example 1 except for fabrication of the oxide solid solution such that 20 mol % of $ZrO_2$ and 80 mol % of $Lu_2O_3$ were contained and adjustment of a mixed amount of the oxide to finally achieve a content of 0.1 mass % in the tungsten electrode material.

Comparative Example 35

Though an attempt to fabricate a tungsten electrode material in the fabrication procedure in Comparative Example 34 was made except for adjustment of a mixed amount of the oxide to finally achieve a content of 10 mass % in the tungsten electrode material, fabrication failed.

Comparative Example 36

A tungsten electrode material was fabricated in the fabrication procedure in Example 1 after mixing of commercially available BaO oxide powders.

Comparative Example 37

A tungsten electrode material was fabricated in the fabrication procedure in Example 1 after mixing of commercially available $Al_2O_3$ oxide powders.

Electrode materials obtained in Examples 3, 4, 18, 19, 41, 42, 53, 54, 65, 66, 77, 78, 89, and 90 and Comparative Examples 9, 14, 19, 24, 29, and 34 each had a relative density of approximately 99%. Electrode materials obtained in Examples 1, 2, 5, 9, 10, 13 to 17, 25 to 40, 48, 52, 60 to 64, 72 to 76, and 84 to 88 and Comparative Examples 1 to 3, 11 to 13, 16 to 18, 21 to 23, 26 to 28, 31 to 33, 36, and 37 each had a relative density of approximately 98%.

Electrode materials obtained in Examples 6, 7, 20, 21, 43, 44, 55, 56, 67, 68, 79, 80, 91, and 92 each had a relative density of approximately 96%, electrode materials obtained in Examples 8, 11, 12, 22 to 24, 45 to 47, 57 to 59, 69 to 71, 81 to 83, and 93 to 95 each had a relative density of approximately 95%, and electrode materials obtained in Comparative Examples 5, 10, 15, 20, 25, 30, and 35 each had a relative density of approximately 92%.

<Results of Checking of State of Oxide by X-Ray Diffraction>

The tungsten electrode materials in Examples 1 to 95 and Comparative Examples 1 to 35 were subjected to X-ray diffraction to check a state of the oxide. An X-ray diffraction peak of a simple substance of a rare-earth oxide and an oxide solid solution corresponds to a lattice constant of the oxide. When the simple substance of the oxide is converted to an oxide solid solution, a lattice constant is varied and hence an X-ray diffraction peak of the oxide solid solution is also varied. Specifically, when an X-ray diffraction peak is plotted in a graph in which the abscissa represents $2\theta/\theta$ and the ordinate represents diffraction intensity, the plot of the oxide solid solution is shifted in the direction of the abscissa and hence a state of the solid solution can be checked. In each Example, formation of the oxide solid solution could be confirmed.

In Comparative Examples 36 and 37, a peak of a simple substance of the oxide could be confirmed.

<Results of Checking of Composition of Oxide by Quantitative Analysis>

The tungsten electrode materials in Examples 1 to 95 and Comparative Examples 1 to 35 were quantitatively analyzed to check a composition of the oxide.

A sample was weighed and separated to a filtrate and a precipitate by acid dissolution. A volume of the filtrate was fixed, and the precipitate was subjected to alkali fusion and then a volume thereof was fixed. A metal element component in the oxide in each of them was quantized by ICP emission spectroscopy and the resultant value was summed. The quantitative value of the metal element component was converted to the oxide and a molar ratio (composition) of the oxide was confirmed. A content with respect to tungsten was determined based on a ratio to the weighed sample. It was confirmed that each of Examples and Comparative Examples satisfied desired molar ratio (composition) and content in Tables.

In Comparative Example 36, separation into the filtrate and the precipitate was made. The precipitate could not be collected. A volume of the filtrate was fixed, a metal element component in the oxide was quantized, the quantitative value of the metal element component was converted to the oxide, and a content with respect to tungsten was determined based on a ratio to the weighed sample.

In Comparative Example 37, separation into the filtrate and the precipitate was made. A volume of the filtrate was fixed. The precipitate was subjected to alkali fusion and then a volume thereof was fixed. A metal element component of the oxide of each of them was quantized by ICP emission spectroscopy and the resultant value was summed. The quantitative value of the metal element component was converted to the oxide, and a content to tungsten was determined based on a ratio to the weighed sample.

<Evaluation of Characteristics of Electrode Material: Voltage Variation>

Characteristics of an electrode material to be used for a discharge lamp or the like were evaluated with the electrode material being incorporated in a TIG discharging apparatus utilizing the same discharging phenomenon. The tungsten electrode material in each of Examples 1 to 95 and Comparative Examples 1 to 37 was in a shape of a rod having a diameter of 6 mm. The electrode material was cut to have a tip end angle of 60°, subjected to heat treatment (1800° C.), and incorporated in the TIG discharging apparatus. The discharge lamp is called a short-arc discharge lamp, and was structured such that a negative electrode (the electrode material to be evaluated) and a positive electrode (a tungsten electrode) were opposed to each other in a quartz tube. The tube was filled with inert gas. The TIG discharging apparatus representing an evaluation method in the present invention was structured such that a negative electrode (the electrode material to be evaluated) and a positive electrode (a tungsten plate) were opposed to each other in air atmosphere. Inert gas was fed between the negative electrode and the positive electrode to protect the electrodes as in the discharge lamp. The discharge lamp and the TIG discharging apparatus were common in generation of discharging between the opposing negative electrode and positive electrode, and alternative assessment could be made. A TIG discharging apparatus such as Inverter Elecon 200P manufactured by Daihen Corporation is commercially available. Constant current control was carried out for direct-current (DC) discharging from the negative electrode toward the positive electrode and for keeping discharging constant.

Voltage variation while a discharge lamp is on is available as an indicator for performance of the TIG discharging apparatus. An amplitude of a voltage (a maximum value−a minimum value) was found, and the amplitude within 1.5 V was determined as high in performance, and the amplitude greater than that was determined as deterioration in performance. Voltage variation while the discharge lamp was on for ten hours in Examples 1 to 95 and Comparative Examples 1 to 4, 6 to 9, 11 to 14, 16 to 19, 21 to 24, 26 to 29, and 31 to 34 was compared. In Comparative Examples 36 and 37, discharging did not occur and the discharge lamp was not turned on.

Reasons why voltage variation in the TIG discharging apparatus serves as the alternative indicator for performance of the discharge lamp are as below.

There are mainly two preferred performances of the discharge lamp, and they are (1) less movement in luminescent spot and (2) maintained illumination. Though (1) has been known to optically be measurable, it can be evaluated also based on voltage variation. When a luminescent spot is more distant from the electrode, a voltage tends to increase, and when a luminescent spot is closer to the electrode, the voltage tends to lower. Therefore, with movement of the luminescent spot, the voltage is varied. Though movement of luminance is optically measurable, complicated equipment is required and difficulty in measurement is high. Voltage variation, on the other hand, can readily be measured by a simple TIG apparatus. Therefore, voltage variation in a TIG discharging apparatus was selected as one of alternative indicators.

Specifically, a tungsten plate (water cooled) having a thickness T of 5 mm×a length of 100 mm×a width of 100 mm was adopted as the positive electrode, and a side having the tip end angle of 60° of the negative electrode (the tungsten electrode material to be evaluated) having a diameter of 6 mm was opposed to the positive electrode. A distance between the negative electrode and the positive electrode was set to 5 mm, and the discharge lamp was turned on by a constant current power supply of 120 A while argon gas was fed by 15 $dm^3$/minute or more. The turned-on state was kept by a DC current, and at a time point of lapse of ten hours in the turned-on state, a voltage across the negative electrode and the positive electrode was measured with a voltage probe of an oscilloscope. Time resolution was set to 0.1 second, and an amplitude of a voltage during one-minute period was defined as voltage variation. Since fabrication failed in Comparative Examples 5, 10, 15, 20, 25, 30, and 35, there is no data on voltage variation.

The tungsten electrode material was thus evaluated based on voltage variation in the TIG discharging apparatus.

TABLE 7

| Sample for Evaluation (Example) | Oxide Solid Solution (figure in parentheses representing composition of rare-earth oxide (mol %)) | Content of Oxide Solid Solution in Tungsten Electrode Material (mass %) | Voltage Variation (during 10-h on period) (V) | Current Variation Rate (%) |
|---|---|---|---|---|
| 1 | $ZrO_2$—$La_2O_3$ (66 mol %) | 1.5 | 1.1 | 2.5 |
| 2 | $ZrO_2$—$La_2O_3$ (70 mol %) | 1.5 | 0.4 | 2.0 |
| 3 | $ZrO_2$—$La_2O_3$ (80 mol %) | 0.5 | 0.9 | 2.5 |
| 4 | $ZrO_2$—$La_2O_3$ (80 mol %) | 0.8 | 0.4 | 2.0 |
| 5 | $ZrO_2$—$La_2O_3$ (80 mol %) | 1.5 | 0.5 | 1.7 |
| 6 | $ZrO_2$—$La_2O_3$ (80 mol %) | 3.0 | 0.4 | 1.4 |
| 7 | $ZrO_2$—$La_2O_2$ (80 mol %) | 5.0 | 0.9 | 1.5 |
| 8 | $ZrO_2$—$La_2O_3$ (80 mol %) | 6.0 | 1.2 | 2.0 |
| 9 | $ZrO_2$—$La_2O_3$ (95 mol %) | 1.5 | 0.4 | 1.9 |
| 10 | $ZrO_2$—$La_2O_3$ (97 mol %) | 1.5 | 0.9 | 2.5 |
| 11 | $ZrO_2$—$La_2O_3$ (80 mol %) | 8.0 | 1.3 | 2.1 |
| 12 | $ZrO_2$—$La_2O_3$ (80 mol %) | 9.0 | 1.3 | 2.3 |

TABLE 8

| Sample for Evaluation (Example) | Oxide Solid Solution (figure in parentheses representing composition of rare-earth oxide (mol %)) | Content of Oxide Solid Solution in Tungsten Electrode Material (mass %) | Voltage Variation (during 10-h on period) (V) | Current Variation Rate (%) |
|---|---|---|---|---|
| 13 | $ZrO_2$—$Nd_2O_3$ (66 mol %) | 1.5 | 0.9 | 2.9 |
| 14 | $ZrO_2$—$Nd_2O_3$ (70 mol %) | 1.5 | 0.4 | 2.8 |
| 15 | $ZrO_2$—$Nd_2O_3$ (80 mol %) | 1.5 | 0.3 | 2.7 |
| 16 | $ZrO_2$—$Nd_2O_3$ (95 mol %) | 1.5 | 0.3 | 2.8 |
| 17 | $ZrO_2$—$Nd_2O_3$ (97 mol %) | 1.5 | 0.6 | 2.9 |
| 18 | $ZrO_2$—$Nd_2O_3$ (80 mol %) | 0.5 | 0.7 | 2.9 |
| 19 | $ZrO_2$—$Nd_2O_3$ (80 mol %) | 0.8 | 0.4 | 2.7 |
| 20 | $ZrO_2$—$Nd_2O_3$ (80 mol %) | 3 | 0.4 | 2.7 |
| 21 | $ZrO_2$—$Nd_2O_3$ (80 mol %) | 5 | 0.7 | 2.6 |
| 22 | $ZrO_2$—$Nd_2O_3$ (80 mol %) | 6 | 1.1 | 2.4 |
| 23 | $ZrO_2$—$Nd_2O_3$ (80 mol %) | 8 | 1.2 | 2.3 |
| 24 | $ZrO_2$—$Nd_2O_3$ (80 mol %) | 9 | 1.3 | 2.2 |
| 25 | $ZrO_2$—$CeO_2$ (90 mol %) | 1.5 | 0.5 | 2.0 |
| 26 | $HfO_2$—$La_2O_3$ (80 mol %) | 1.5 | 0.4 | 2.0 |

TABLE 9

| Sample for Evaluation (Comparative Example) | Oxide Solid Solution (figure in parentheses representing composition of rare-earth oxide (mol %)) | Content of Oxide Solid Solution in Tungsten Electrode Material (mass %) | Voltage Variation (during 10-h on period) (V) | Current Variation Rate (%) |
|---|---|---|---|---|
| 1 | $ZrO_2$—$La_2O_3$ (30 mol %) | 1.5 | 2.7 | 4.3 |
| 2 | $ZrO_2$—$La_2O_3$ (60 mol %) | 1.5 | 1.8 | 4.0 |
| 3 | $ZrO_2$—$La_2O_3$ (99 mol %) | 1.5 | 1.5 | 4.1 |
| 4 | $ZrO_2$—$La_2O_3$ (80 mol %) | 0.1 | 2.3 | Immeasurable |
| 5 | $ZrO_2$—$La_2O_3$ (80 mol %) | 10 | No Data Available Failure in Fabrication | Failure in Fabrication |
| 6 | $ZrO_2$—$Nd_2O_3$ (30 mol %) | 1.5 | 2.4 | 4.0 |
| 7 | $ZrO_2$—$Nd_2O_3$ (60 mol %) | 1.5 | 1.7 | 4.0 |
| 8 | $ZrO_2$—$Nd_2O_3$ (99 mol %) | 1.5 | 1.5 | 4.3 |
| 9 | $ZrO_2$—$Nd_2O_3$ (80 mol %) | 0.1 | 2.1 | Immeasurable |
| 10 | $ZrO_2$—$Nd_2O_3$ (80 mol %) | 10 | No Data Available Failure in Fabrication | Failure in Fabrication |

TABLE 10

| Sample for Evaluation (Example) | Oxide Solid Solution (figure in parentheses representing composition of rare-earth oxide (mol %)) | Content of Oxide Solid Solution in Tungsten Material (mass %) | Voltage Variation (during 10-h on period) (V) | Current Variation Rate (%) |
|---|---|---|---|---|
| 27 | $ZrO_2$—$Sc_2O_3$ (90 mol %) | 1.5 | 0.4 | 1.8 |
| 28 | $ZrO_2$—$Sm_2O_3$ (90 mol %) | 1.5 | 0.6 | 2.3 |
| 29 | $ZrO_2$—$Eu_2O_3$ (90 mol %) | 1.5 | 0.6 | 2.4 |

TABLE 10-continued

| Sample for Evaluation (Example) | Oxide Solid Solution (figure in parentheses representing composition of rare-earth oxide (mol %)) | Content of Oxide Solid Solution in Tungsten Material (mass %) | Voltage Variation (during 10-h on period) (V) | Current Variation Rate (%) |
|---|---|---|---|---|
| 30 | $ZrO_2$—$Tb_2O_3$ (90 mol %) | 1.5 | 0.5 | 2.1 |
| 31 | $ZrO_2$—$Dy_2O_3$ (90 mol %) | 1.5 | 0.6 | 2.4 |
| 32 | $ZrO_2$—$Ho_2O_3$ (90 mol %) | 1.5 | 0.5 | 2.2 |
| 33 | $ZrO_2$—$Er_2O_3$ (90 mol %) | 1.5 | 0.5 | 2.1 |
| 34 | $ZrO_2$—$Tm_2O_3$ (90 mol %) | 1.5 | 0.5 | 2.0 |
| 35 | $ZrO_2$—$Yb_2O_3$ (90 mol %) | 1.5 | 0.5 | 1.9 |
| 36 | $ZrO_2$—$CeO_2$ (66 mol %) | 1.5 | 1.2 | 2.4 |
| 37 | $ZrO_2$—$CeO_2$ (70 mol %) | 1.5 | 0.5 | 2.1 |
| 38 | $ZrO_2$—$CeO_2$ (80 mol %) | 1.5 | 0.5 | 2.1 |
| 39 | $ZrO_2$—$CeO_2$ (95 mol %) | 1.5 | 0.5 | 1.9 |
| 40 | $ZrO_2$—$CeO_2$ (97 mol %) | 1.5 | 1.0 | 2.4 |
| 41 | $ZrO_2$—$CeO_2$ (80 mol %) | 0.5 | 1.0 | 2.4 |
| 42 | $ZrO_2$—$CeO_2$ (80 mol %) | 0.8 | 0.5 | 2.2 |
| 43 | $ZrO_2$—$CeO_2$ (80 mol %) | 3 | 0.4 | 1.8 |
| 44 | $ZrO_2$—$CeO_2$ (80 mol %) | 5 | 0.8 | 1.5 |
| 45 | $ZrO_2$—$CeO_2$ (80 mol %) | 6 | 1.1 | 2.0 |
| 46 | $ZrO_2$—$CeO_2$ (80 mol %) | 8 | 1.3 | 2.2 |
| 47 | $ZrO_2$—$CeO_2$ (80 mol %) | 9 | 1.4 | 2.3 |

TABLE 11

| Sample for Evaluation (Example) | Oxide Solid Solution (figure in parentheses representing composition of rare-earth oxide (mol %)) | Content of Oxide in Tungsten Material (mass %) | Voltage Variation (during 10-h on period) (V) | Current Variation Rate (%) |
|---|---|---|---|---|
| 48 | $ZrO_2$—$Y_2O_3$ (66 mol %) | 1.5 | 1.0 | 2.7 |
| 49 | $ZrO_2$—$Y_2O_3$ (70 mol %) | 1.5 | 0.3 | 2.5 |
| 50 | $ZrO_2$—$Y_2O_3$ (80 mol %) | 1.5 | 0.4 | 2.1 |
| 51 | $ZrO_2$—$Y_2O_3$ (95 mol %) | 1.5 | 0.3 | 2.5 |
| 52 | $ZrO_2$—$Y_2O_3$ (97 mol %) | 1.5 | 0.8 | 2.9 |
| 53 | $ZrO_2$—$Y_2O_3$ (80 mol %) | 0.5 | 0.8 | 2.0 |
| 54 | $ZrO_2$—$Y_2O_3$ (80 mol %) | 0.8 | 0.3 | 1.8 |
| 55 | $ZrO_2$—$Y_2O_3$ (80 mol %) | 3 | 0.3 | 2.3 |
| 56 | $ZrO_2$—$Y_2O_3$ (80 mol %) | 5 | 0.8 | 2.5 |
| 57 | $ZrO_2$—$Y_2O_3$ (80 mol %) | 6 | 1.1 | 2.5 |
| 58 | $ZrO_2$—$Y_2O_3$ (80 mol %) | 8 | 1.2 | 2.7 |
| 59 | $ZrO_2$—$Y_2O_3$ (80 mol %) | 9 | 1.2 | 2.7 |
| 60 | $ZrO_2$—$Pr_2O_3$ (66 mol %) | 1.5 | 1.0 | 2.7 |
| 61 | $ZrO_2$—$Pr_2O_3$ (70 mol %) | 1.5 | 0.5 | 2.5 |
| 62 | $ZrO_2$—$Pr_2O_3$ (80 mol %) | 1.5 | 0.5 | 2.1 |
| 63 | $ZrO_2$—$Pr_2O_3$ (95 mol %) | 1.5 | 0.4 | 2.5 |
| 64 | $ZrO_2$—$Pr_2O_3$ (97 mol %) | 1.5 | 0.8 | 2.9 |
| 65 | $ZrO_2$—$Pr_2O_3$ (80 mol %) | 0.5 | 0.9 | 2.0 |
| 66 | $ZrO_2$—$Pr_2O_3$ (80 mol %) | 0.8 | 0.5 | 1.8 |
| 67 | $ZrO_2$—$Pr_2O_3$ (80 mol %) | 3 | 0.4 | 2.3 |
| 68 | $ZrO_2$—$Pr_2O_3$ (80 mol %) | 5 | 0.8 | 2.5 |
| 69 | $ZrO_2$—$Pr_2O_3$ (80 mol %) | 6 | 1.1 | 2.5 |
| 70 | $ZrO_2$—$Pr_2O_3$ (80 mol %) | 8 | 1.3 | 2.7 |
| 71 | $ZrO_2$—$Pr_2O_3$ (80 mol %) | 9 | 1.4 | 2.7 |

TABLE 12

| Sample for Evaluation (Example) | Oxide Solid Solution (figure in parentheses representing composition of rare-earth oxide (mol %)) | Content of Oxide in Tungsten Material (mass %) | Voltage Variation (during 10-h on period) (V) | Current Variation Rate (%) |
|---|---|---|---|---|
| 72 | $ZrO_2$—$Gd_2O_3$ (66 mol %) | 1.5 | 1.1 | 2.8 |
| 73 | $ZrO_2$—$Gd_2O_3$ (70 mol %) | 1.5 | 0.4 | 2.1 |
| 74 | $ZrO_2$—$Gd_2O_3$ (80 mol %) | 1.5 | 0.4 | 1.9 |
| 75 | $ZrO_2$—$Gd_2O_3$ (95 mol %) | 1.5 | 0.4 | 2.1 |
| 76 | $ZrO_2$—$Gd_2O_3$ (97 mol %) | 1.5 | 0.9 | 2.7 |
| 77 | $ZrO_2$—$Gd_2O_3$ (80 mol %) | 0.5 | 0.9 | 2.4 |
| 78 | $ZrO_2$—$Gd_2O_3$ (80 mol %) | 0.8 | 0.4 | 1.7 |
| 79 | $ZrO_2$—$Gd_2O_3$ (80 mol %) | 3 | 0.3 | 2.1 |
| 80 | $ZrO_2$—$Gd_2O_3$ (80 mol %) | 5 | 0.7 | 2.2 |
| 81 | $ZrO_2$—$Gd_2O_3$ (80 mol %) | 6 | 1.0 | 2.2 |
| 82 | $ZrO_2$—$Gd_2O_3$ (80 mol %) | 8 | 1.2 | 2.4 |
| 83 | $ZrO_2$—$Gd_2O_3$ (80 mol %) | 9 | 1.3 | 2.6 |

TABLE 12-continued

| Sample for Evaluation (Example) | Oxide Solid Solution (figure in parentheses representing composition of rare-earth oxide (mol %)) | Content of Oxide in Tungsten Material (mass %) | Voltage Variation (during 10-h on period) (V) | Current Variation Rate (%) |
|---|---|---|---|---|
| 84 | $ZrO_2$—$Lu_2O_3$ (66 mol %) | 1.5 | 1.3 | 2.6 |
| 85 | $ZrO_2$—$Lu_2O_3$ (70 mol %) | 1.5 | 0.5 | 1.7 |
| 86 | $ZrO_2$—$Lu_2O_3$ (80 mol %) | 1.5 | 0.5 | 1.5 |
| 87 | $ZrO_2$—$Lu_2O_3$ (95 mol %) | 1.5 | 0.5 | 1.9 |
| 88 | $ZrO_2$—$Lu_2O_3$ (97 mol %) | 1.5 | 1.1 | 2.5 |
| 89 | $ZrO_2$—$Lu_2O_3$ (80 mol %) | 0.5 | 1.1 | 2.2 |
| 90 | $ZrO_2$—$Lu_2O_3$ (80 mol %) | 0.8 | 0.5 | 1.5 |
| 91 | $ZrO_2$—$Lu_2O_3$ (80 mol %) | 3 | 0.5 | 2.0 |
| 92 | $ZrO_2$—$Lu_2O_3$ (80 mol %) | 5 | 0.9 | 2.2 |
| 93 | $ZrO_2$—$Lu_2O_3$ (80 mol %) | 6 | 1.2 | 2.4 |
| 94 | $ZrO_2$—$Lu_2O_3$ (80 mol %) | 8 | 1.3 | 2.6 |
| 95 | $ZrO_2$—$Lu_2O_3$ (80 mol %) | 9 | 1.4 | 2.7 |

TABLE 13

| Sample for Evaluation (Comparative Example) | Oxide Solid Solution (figure in parentheses representing compositionof rare-earth oxide (mol %)) | Content of Oxide in Tungsten Material (mass %) | Voltage Variation (during 10-h on period) (V) | Current Variation Rate (%) |
|---|---|---|---|---|
| 11 | $ZrO_2$—$CeO_2$ (30 mol %) | 1.5 | 2.9 | 4.1 |
| 12 | $ZrO_2$—$CeO_2$ (60 mol %) | 1.5 | 1.9 | 4.0 |
| 13 | $ZrO_2$—$CeO_2$ (99 mol %) | 1.5 | 1.6 | 4.0 |
| 14 | $ZrO_2$—$CeO_2$ (80 mol %) | 0.1 | 2.7 | Immeasurable |
| 15 | $ZrO_2$—$CeO_2$ (80 mol %) | 10 | Failure in Fabrication | Failure in Fabrication |
| 16 | $ZrO_2$—$Y_2O_3$ (30 mol %) | 1.5 | 2.6 | 3.8 |
| 17 | $ZrO_2$—$Y_2O_3$ (60 mol %) | 1.5 | 1.7 | 3.8 |
| 18 | $ZrO_2$—$Y_2O_3$ (99 mol %) | 1.5 | 1.5 | 4.3 |
| 19 | $ZrO_2$—$Y_2O_3$ (80 mol %) | 0.1 | 2.2 | Immeasurable |
| 20 | $ZrO_2$—$Y_2O_3$ (80 mol %) | 10 | Failure in Fabrication | Failure in Fabrication |
| 21 | $ZrO_2$—$Pr_2O_3$ (30 mol %) | 1.5 | 2.4 | 3.8 |
| 22 | $ZrO_2$—$Pr_2O_3$ (60 mol %) | 1.5 | 1.8 | 3.8 |
| 23 | $ZrO_2$—$Pr_2O_3$ (99 mol %) | 1.5 | 1.6 | 4.3 |
| 24 | $ZrO_2$—$Pr_2O_3$ (80 mol %) | 0.1 | 2.2 | Immeasurable |
| 25 | $ZrO_2$—$Pr_2O_3$ (80 mol %) | 10 | Failure in Fabrication | Failure in Fabrication |
| 26 | $ZrO_2$—$Gd_2O_3$ (30 mol %) | 1.5 | 2.8 | 4.3 |
| 27 | $ZrO_2$—$Gd_2O_3$ (60 mol %) | 1.5 | 1.8 | 3.9 |
| 28 | $ZrO_2$—$Gd_2O_3$ (99 mol %) | 1.5 | 1.5 | 4.0 |
| 29 | $ZrO_2$—$Gd_2O_3$ (80 mol %) | 0.1 | 2.6 | Immeasurable |
| 30 | $ZrO_2$—$Gd_2O_3$ (80 mol %) | 10 | Failure in Fabrication | Failure in Fabrication |
| 31 | $ZrO_2$—$Lu_2O_3$ (30 mol %) | 1.5 | 3.0 | 4.6 |
| 32 | $ZrO_2$—$Lu_2O_3$ (60 mol %) | 1.5 | 2.0 | 4.0 |
| 33 | $ZrO_2$—$Lu_2O_3$ (99 mol %) | 1.5 | 1.7 | 3.8 |
| 34 | $ZrO_2$—$Lu_2O_3$ (80 mol %) | 0.1 | 2.8 | Immeasurable |
| 35 | $ZrO_2$—$Lu_2O_3$ (80 mol %) | 10 | Failure in Fabrication | Failure in Fabrication |
| 36 | BaO | 1.5 | Not Turned-On | Immeasurable |
| 37 | $Al_2O_3$ | 1.5 | Not Turned-On | Immeasurable |

It was found that a composition (mol %) of the rare-earth oxide in the oxide solid solution had to be not lower than 66 mol % and not higher than 97 mol %. In particular, it was found that a composition of the rare-earth oxide in the oxide solid solution was preferably not lower than 70 mol % and not higher than 95 mol %.

It was found that a content of the oxide solid solution had to be not lower than 0.5 mass % and not higher than 9 mass %. In particular, it was found that a content of the oxide solid solution was preferably not lower than 0.8 mass % and not higher than 3 mass %.

As shown in Tables, it was found that the electrode material containing the oxide solid solution in each of Examples 1 to 95 was less in voltage variation and higher in characteristics than the electrode materials in Comparative Examples 1 to 35 according to the conventional techniques.

In comparison based on a composition ratio of a rare-earth oxide with a content and a rare-earth element being identical, for example, regarding $ZrO_2$—$La_2O_3$, Examples 1, 2, 5, 9, and 10 were better than Comparative Examples 1 to 3, and in particular, Examples 2, 5, and 9 were excellent. Regarding $ZrO_2$—$Nd_2O_3$, Examples 13 to 17 were better than Comparative Examples 6 to 8, and in particular, Examples 14 to 16 were excellent.

In comparison based on a content with a composition ratio of a rare-earth element and a rare-earth oxide being identical, regarding $ZrO_2$—$La_2O_3$, Examples 3 to 8, 11, and 12 were better in characteristics than Comparative Examples 4 and 5. Regarding $ZrO_2$—$Nd_2O_3$, Examples 15 and 18 to 24 were better in characteristics than Comparative Examples 9 and 10.

Though the oxides contained in the tungsten electrode materials in Examples 1 to 95 and Comparative Examples 1 to 35 were in the same state of the solid solution, Examples were consequently less in voltage variation. The electrode material within the scope of Examples is considered as being further preferable for applications of discharge lamps.

<Evaluation of Characteristics of Electrode Material: Current Variation Rate>

Characteristics of an electrode material to be used for a discharge lamp or the like were evaluated also by a method of measuring a thermionic emission current from which discharging originated (the measurement method described in Japanese Patent Laying-Open No. 2010-161061). The tungsten electrode material in each of Examples 1 to 95 and Comparative Examples 1 to 4, 6 to 9, 11 to 14, 16 to 19, 21 to 24, 26 to 29, 31 to 34, 36, and 37 was cut, polished, and degreased to fabricate a columnar sample for evaluation having a diameter of 8 mm and a height of 10 mm. Then, measurement below was conducted.

Specifically, each sample for evaluation was set in a vacuum chamber, the vacuum chamber was kept in a vacuum atmosphere (not higher than $10^{-4}$ Pa), and the sample for evaluation was heated by electron bombardment and held at 1850° C. A rate of increase in temperature during heating was set to 15 K/min. and a filament of an electron source was heated at 5 V and 24 A while the temperature was held. Then, 3.2 kV of an acceleration voltage for electron bombardment was applied to feed a current of 110 mA. A radiation thermometer TR-630A manufactured by Minolta Co., Ltd. was employed for measuring a temperature of the sample for evaluation. The temperature of the sample was calculated by using effective emissivity of 0.92 calculated by multiplying emissivity of 1 of the sample for evaluation and absorptance of 0.92 on an optical path by each other. In general, when a deep hole is provided in a measurement target, emissivity at the bottom of that hole can be regarded as 1. Therefore, a hole for temperature measurement having a ratio L/r of 10 between a hole depth L=10 and a radius r=1 was provided, and emissivity of the sample for evaluation was regarded as 1. Absorptance at a window in the vacuum chamber was measured as 0.92, which was defined as absorptance on the optical path.

Thermionic emission was measured by applying a pulse voltage of 400 V to the electrode opposed to the sample for evaluation defined as a cathode. A surface of the sample from which thermions were emitted and a surface of an electrode (which is referred to as an anode below) opposed to the sample at which thermions were supplied and received were polished, and surface roughens thereof was not greater than Ra of 1.6 μm. A pulse duty representing a ratio between a time period in which the pulse voltage was applied and a time period in which the pulse voltage was not applied was set to 1:1000.

When the anode alone was provided, intensity of electric field between the anode and the cathode resulting from the applied pulse voltage became non-uniform between a central portion of the electrode and an end portion of the electrode. Therefore, a guard ring was provided around an outer circumference of the anode. The guard ring had an outer diameter of 11 mm and an inner diameter of 6.6 mm. A pulse voltage in synchronization with the electrode was applied to the guard ring. The anode and the guard ring were held in parallel to the sample for evaluation, and a distance therebetween was set to 0.5 mm. A position of the anode was adjusted to be coaxial with the sample for evaluation.

A thermionic emission surface of the sample for evaluation to serve as the cathode had a diameter D of 8.0 mm, and a cross-section of the anode had a diameter D of 6.2 mm. Thermions which reached the cross-section of the anode (that is, the cross-section having diameter D of 6.2 mm) from the sample for evaluation as the cathode were supplied and received to thereby measure a current value. An oscilloscope was employed for measurement, and a current at the time of application of a pulse voltage was read. The current value was divided by a cross-sectional area of the anode to calculate a current density.

Change over time in current density caused by thermionic emission was thus recorded while the sample for evaluation of the tungsten electrode material according to the present invention was held at 1850° C.

A maximum value, a minimum value, and an average value ((maximum value+minimum value)/2) were calculated from values of the current density obtained during a period of 60 seconds since start of measurement (0 second), and a current variation rate defined as below was calculated.

$$\text{Current variation rate (\%)} = (\text{maximum value} - \text{minimum value})/\text{average value} \times 100$$

A current variation rate during a 60-second period after lapse of one hour since start of measurement (0 second) was similarly calculated. Though an absolute value of the current was attenuated, the rate of variation was similar. Therefore, Examples and Comparative Examples were compared based on a value during a period from 0 to 60 seconds.

Reasons why the current variation rate serves as an alternative indicator for performance of the discharge lamp are estimated as below.

A luminescent spot in a discharge lamp is considered as electric energy introduced to the discharge lamp being converted into light. A quantity of electric energy is determined by electric power represented by a product of a voltage applied to the discharge lamp and a current. Therefore, it is estimated that less variation in electric power is preferred. The reason why voltage variation serves as an alternative indicator for movement of a luminescent spot is as described previously. Though a current is generally subjected to constant current control by a turn-on circuit, variation in current originating from an electrode may be a factor for disturbance in control of the circuit. Therefore, it was estimated that the current variation rate defined above was preferably less.

Since fabrication failed in Comparative Examples 5, 10, 15, 20, 25, 30, and 35, a current variation rate could not be measured. Since the current variation rate was lower than the measurement lower limit of the apparatus in Comparative Examples 4, 9, 14, 19, 24, 29, 34, 36, and 37, the current variation rate could not be measured.

As shown in Tables 7 to 13, it was found that the electrode materials containing the oxide solid solution in Examples 1 to 95 were lower in current variation rate and better in characteristics than the electrode materials in Comparative Examples 1 to 35 according to the conventional techniques.

The tungsten electrode material according to one manner of the present invention can be used for an electrode even though it remains as a sintered material.

The tungsten electrode material containing the oxide solid solution is not limited to an electrode in a shape of a column or a rod. Depending on an application, for example, a compact formed into a quadrangular plate can be sintered and this sintered material can also be employed as an electrode.

Granularity or purity of a tungsten oxide or tungsten to be mixed is not particularly restricted either. Powders of a tungsten alloy such as a tungsten-rhenium alloy excellent in strength at a high temperature or powders obtained by doping tungsten powders with a certain amount of aluminum, potassium, or silicon may be employed. A reason of use of doped powders is that doping contributes to increase in aspect ratio of tungsten crystal grains or stabilization of tungsten crystal grain boundaries.

The tungsten electrode material according to one manner of the present invention is used for a negative electrode of a discharge lamp, and in addition, it can also be used for an electrode and a filament of various lamps which require a thermionic emission phenomenon, a negative electrode for magnetron, an electrode for tungsten inert gas (TIG) welding, and an electrode for plasma welding.

A tungsten electrode material containing oxide particles has generally been known to achieve improvement in strength at a high temperature and impact resistance owing to suppression of dislocation of tungsten grain boundaries, and application thereof to a high-temperature member can also be made.

It should be understood that the embodiment and the examples disclosed herein are illustrative and non-restrictive in every respect. The scope of the present invention is defined by the terms of the claims rather than the embodiment above and is intended to include any modifications within the scope and meaning equivalent to the terms of the claims.

The invention claimed is:

1. A tungsten electrode material comprising:

a tungsten-based material; and oxide particles dispersed in the tungsten-based material, the oxide particles being composed of an oxide solid solution in which a Zr oxide and/or an Hf oxide and an oxide of at least one rare earth selected from the group consisting of Sc, Y, La, Ce, Pr, Nd, Sm, Eu, Gd, Tb, Dy, Ho, Er, Tm, Yb, and Lu are dissolved as a solid solution, a content of the oxide of the rare-earth with respect to a total amount of the Zr oxide and/or the Hf oxide and the oxide of the rare earth being not lower than 66 mol % and not higher than 97 mol %, a content of the oxide solid solution being not lower than 0.5 mass % and not higher than 9 mass %, and a remainder being composed substantially of tungsten.

2. The tungsten electrode material according to claim 1, wherein the content of the oxide of the rare earth to the total amount of the Zr oxide and/or the Hf oxide and the oxide of the rare earth is not lower than 70 mol % and not higher than 95 mol %.

3. The tungsten electrode material according to claim 1, wherein the content of the oxide solid solution is not lower than 0.8 mass % and not higher than 3 mass % and the remainder is composed substantially of tungsten.

4. The tungsten electrode material according to claim 1, wherein a difference between a maximum value and a minimum value of a voltage during discharging is smaller than 1.5 V.

5. The tungsten electrode material according to claim 1, wherein a difference between a maximum value and a minimum value of a current density attributed to thermionic emission is smaller than 3.0% with respect to an average value.

* * * * *